US011279527B2

(12) United States Patent
Goto et al.

(10) Patent No.: US 11,279,527 B2
(45) Date of Patent: Mar. 22, 2022

(54) BAG WITH ZIPPER TAPE AND MANUFACTURING METHOD THEREFOR

(71) Applicant: IDEMITSU UNITECH CO., LTD., Tokyo (JP)

(72) Inventors: Shuichi Goto, Chiba (JP); Ryo Katada, Chiba (JP); Takumi Todaka, Chiba (JP)

(73) Assignee: IDEMITSU UNITECH CO., LTD., Tokyo (JP)

( * ) Notice: Subject to any disclaimer, the term of this patent is extended or adjusted under 35 U.S.C. 154(b) by 71 days.

(21) Appl. No.: 14/904,531

(22) PCT Filed: Jul. 3, 2014

(86) PCT No.: PCT/JP2014/067787
§ 371 (c)(1),
(2) Date: Jan. 12, 2016

(87) PCT Pub. No.: WO2015/005214
PCT Pub. Date: Jan. 15, 2015

(65) Prior Publication Data

US 2016/0194117 A1 Jul. 7, 2016

(30) Foreign Application Priority Data

Jul. 12, 2013 (JP) ..... JP2013-146833

(51) Int. Cl.
*B65D 33/25* (2006.01)

(52) U.S. Cl.
CPC ..... *B65D 33/2541* (2013.01)

(58) Field of Classification Search
CPC ..... B65D 33/25; B65D 33/2508; B65D 33/2516; B65D 33/2525; B65D 33/2533;
(Continued)

(56) References Cited

U.S. PATENT DOCUMENTS 4,578,813 A * 3/1986 Ausnit ..... B65D 33/2541 383/63
4,672,723 A * 6/1987 Hugues et al.
(Continued)

FOREIGN PATENT DOCUMENTS

CN 101522538 A 9/2009
JP 59-147047 U 10/1984
(Continued)

OTHER PUBLICATIONS

International Preliminary Report on Patentability dated Jan. 12, 2016 issued in corresponding PCT/JP2014/067787 application (pp. 1-5).
(Continued)

*Primary Examiner* — Jes F Pascua
*Assistant Examiner* — Nina K Attel
(74) *Attorney, Agent, or Firm* — Millen, White, Zelano & Branigan, PC; Ryan Pool

(57) ABSTRACT

A bag body includes a bag main body and a zipper tape heat-sealed to an inner surface of the bag main body. The zipper tape comprises a pair of belt-shaped bases and two pairs of mating portions configured to be mated with each other. One of the belt-shaped bases is attached to the bag main body only at a widthwise side near an opening. First one of the mating portions includes a pair of hooks provided to each of the belt-shaped bases and respectively having nails at ends of the hooks that are configured to be meshed with each other. The second mating portion includes a concave female mating portion provided to the belt-shaped base and a male mating portion having the same shape as the hook and configured to disengageably mate with the female mating portion. The nail of the hook protrudes toward the opening.

5 Claims, 23 Drawing Sheets

(58) Field of Classification Search
CPC ..... B65D 33/2541; B65D 33/255; B65D 33/2558; B65D 33/2566; B65D 33/2575; B65D 33/2583; B65D 33/2591
USPC ..... 383/61.1, 63, 64, 65
See application file for complete search history.

(56) References Cited

U.S. PATENT DOCUMENTS

| | | | | |
|---|---|---|---|---|
| 4,817,188 | A * | 3/1989 | Van Erden | B65D 33/2508 24/287 |
| 5,368,394 | A * | 11/1994 | Scott | B65D 33/2541 24/DIG. 50 |
| 2004/0234172 | A1* | 11/2004 | Pawloski | B65D 33/2541 383/61.2 |
| 2005/0084183 | A1* | 4/2005 | Ausnit | B65D 33/2591 383/64 |
| 2005/0271308 | A1* | 12/2005 | Pawloski | B65D 33/2508 383/63 |
| 2006/0111226 | A1* | 5/2006 | Anzini | B65D 33/2508 493/214 |
| 2006/0120630 | A9* | 6/2006 | Ausnit | B65D 33/2591 383/64 |
| 2008/0159663 | A1* | 7/2008 | Pham | B65D 33/2591 383/64 |
| 2008/0226203 | A1* | 9/2008 | Dais | B65D 33/2508 383/63 |
| 2011/0194790 | A1* | 8/2011 | Kosub | B29D 5/10 383/64 |
| 2012/0036684 | A1* | 2/2012 | Tilman | B65D 33/2541 24/399 |
| 2012/0045151 | A1* | 2/2012 | Eouzan | B65D 33/2541 383/42 |
| 2013/0108188 | A1* | 5/2013 | Karim | B31B 19/00 383/37 |
| 2014/0119678 | A1* | 5/2014 | Ausnit | B65D 33/2591 383/64 |

FOREIGN PATENT DOCUMENTS

| | | | |
|---|---|---|---|
| JP | 6-92363 | A | 4/1994 |
| JP | 8-268445 | A | 10/1996 |
| JP | 10-264946 | A | 10/1998 |
| JP | 2009-5736 | A | 1/2009 |
| JP | 2012-41089 | A | 3/2012 |
| JP | 2013-6606 | A | 1/2013 |

OTHER PUBLICATIONS

Chinese Office Action dated Apr. 24, 2017 issued in corresponding CN 201480039344.1 application (9 pages).
Notice of Reason(s) for Rejection dated Jun. 20, 2017 issued in corresponding JP 2013-146833 application (2 pages).
English Abstract of JP H 06-92363 A published Apr. 5, 1994.
English Abstract of CN 101522538 A published Sep. 2, 2009.
International Search Report dated Sep. 30, 2014 issued in corresponding PCT/JP2014/067787 application (pp. 1-2).
English Abstract of JPH 08-268445 A published Oct. 15, 1996.
English Abstract of JPH 10-264946 A published Oct. 6, 1998.
English Abstract of JP 2009-005736 A published Jan. 15, 2009.
English Abstract of JP 2012-041089 A published Mar. 1, 2012.
English Abstract of JP 2013-006606 A published Jan. 10, 2013.

* cited by examiner

BAG WITH ZIPPER TAPE AND MANUFACTURING METHOD THEREFOR

TECHNICAL FIELD

The present invention relates to a zipper-tape-attached bag body attached with a zipper tape, and a production method thereof.

BACKGROUND ART

There have been typically known various bag bodies attached with zipper tapes in the field of packaging medicine, food and the like. Sealing performance and pressure resistance sufficient for preventing leakage of contents (e.g. powder and liquid) when the zipper tape is engaged are desired in some of the zipper-tape-attached bag bodies (see, for instance, Patent Literature 1).

The bag body disclosed in Patent Literature 1 includes a zipper tape provided with a pair of belt-shaped bases and first and second mating portions provided in parallel thereon, the zipper tape being provided to an opening of a bag main body. The first one of the belt-shaped bases of the zipper tape is attached to the bag main body. The second one of the belt-shaped bases is attached to the bag main body only at a peripheral portion thereof near the opening but is not adhered to the bag main body at a peripheral portion near the containing portion. When internal pressure is applied to the bag main body, pressure acts between the second one of the belt-shaped bases and the bag main body, a part of the pressure acting on the mutually engaged mating portions to prevent the leakage of the contents through the mating portions.

CITATION LIST

Patent Literature(s)

Patent Literature 1 JP-A-8-268445

SUMMARY OF THE INVENTION

Problem(s) to be Solved by the Invention

In order to enhance the pressure resistance to prevent the leakage of the contents, the mating portions may be more tightly mated in the above typical zipper-tape-attached bag body. However, when the mating portions are tightly mated, a large force is required for releasing the mating of the mating portions when the contents are taken out or fed through an upper portion of the bag, whereby it becomes difficult to open the bag.

An object of the invention is to provide a zipper-tape-attached bag body capable of achieving contradictory both of high sealing performance and easy-openability, and a production method thereof.

Means for Solving the Problem(s)

A zipper-tape-attached bag body according to an aspect of the invention includes: a bag main body with an opening; and a zipper tape including: a first mating member comprising a first belt-shaped base attached along the opening of the bag main body, and a stop portion provided to the first belt-shaped base; and a second mating member comprising a second belt-shaped base attached along the opening of the bag main body and an engagement portion being provided on the second belt-shaped base, the stop portion being configured to be mated with the engagement portion, in which only a widthwise side of one of the first and second belt-shaped bases near the opening is attached to the bag main body, the stop portion provided to the first belt-shaped base comprises a first nail protruding only toward the opening, and the engagement portion provided to the second belt-shaped base comprises a second nail protruding only toward an interior of the bag main body and configured to be engaged with the first nail.

In the above aspect of the invention, only the widthwise side of the first belt-shaped base near the opening of the bag main body is attached to the bag main body, the first nail protruding only toward the opening is provided to the first belt-shaped base, and the second nail protruding only toward an interior of the bag main body is provided to the second belt-shaped base, in which the first and second nails are mutually engageable/disengageable. With the above arrangement (i.e. a so-called cantilever arrangement in which only one side of the first belt-shaped base is attached), when being applied, the internal pressure acts on the first one of the belt-shaped bases so that the first one of the belt-shaped bases is moved toward the opening (i.e. in a shear direction to move the belt-shaped bases), where the internal pressure acts between the bag main body and the first belt-shaped base and a part of the internal pressure acts on the mating portion. Accordingly, the shear direction of the belt-shaped bases is aligned in a direction for the nails of the mating portions to be meshed with each other, thereby providing high sealing performance. In addition, in order to disengage the mating portions, it is only necessary to separate a side of the bag main body near the opening to keep the nails of the mating portion from being meshed, thereby easily unsealing the tape.

A zipper-tape-attached bag body according to another aspect of the invention includes: a bag main body with an opening; and a zipper tape including: a first mating member comprising a first belt-shaped base attached along the opening of the bag main body, and a stop portion provided to the first belt-shaped base; and a second mating member comprising a second belt-shaped base attached along the opening of the bag main body and an engagement portion being provided on the second belt-shaped base, the stop portion being configured to be mated with the engagement portion, in which only a widthwise side of one of first and second belt-shaped bases near the opening is attached to the bag main body, and the stop portion and the engagement portion respectively comprises a first nail and a second nail, the first nail and the second nail being meshed with each other only when a stress for displacing the one of the first and second belt-shaped bases toward the opening with respect to the other of the first and second belt-shaped bases is applied.

In the above aspect of the invention, only the widthwise side of the first belt-shaped base near the opening of the bag main body is attached to the bag main body, the first nail and the second nail are provided to the mating portions, the first nail and the second nail being meshed with each other only when a stress for displacing the one of the first and second belt-shaped bases toward the opening with respect to the other of the first and second belt-shaped bases is applied. With the above arrangement (i.e. a so-called cantilever arrangement in which only one side of the first belt-shaped base is attached), when being applied, the internal pressure acts on the first belt-shaped base so that the first belt-shaped base is moved toward the opening (i.e. in a shear direction to move the first and second belt-shaped bases), where the internal pressure acts between the bag main body and the first belt-shaped base and a part of the internal pressure acts on the mating portion. Accordingly, the shear direction of the belt-shaped bases is aligned in a direction for the nails of the mating portions to be meshed with each other, thereby providing high sealing performance. In addition, in order to disengage the mating portions, it is only necessary to separate a side of the bag main body near the opening to keep the nails of the mating portion from being meshed, thereby easily unsealing the tape.

Herein, the term "mate (mating)" means that the two components are interlocked with each other, including a state where the two components are fitted with each other. The term "mesh (meshing)" refers to a state where the nails are mutually stopped, specifically, are being hooked with each other or to be hooked when an external force is applied. The mesh (meshing) is included in "mate (mating)" in a broad sense. The "stop" in the stop portion of the above aspect of the invention refers to a state where the stop portion is engaged to be stopped by the engagement portion, where, as described above, the nails are mutually hooked. Similarly, the term "engage (engagement)" for the engagement portion refers to a state where the engagement portion interacts with the stop portion, where, as described above, the engagement portion and the stop portion are mutually hooked.

In the above arrangement, it is preferable that the stop portion and the engagement portion include a plurality of pairs of the stop portion and the engagement portion.

According to the above arrangement, since the plurality of pairs of the stop portions and the engagement portions are provided, the openability is not so much impaired and the mating strength can be greatly increased, thereby providing high sealing performance.

In the above, the number of the "plurality of pairs" is preferably in a range from 1 to 5, more preferably in a range from 1 to 3, especially preferably in a range from 1 to 2. When the number of the pairs is more than five, for instance, the side seal is difficult to be collapsed during the bag-making process, resulting in decrease in processability and increase in resistance during an opening operation (i.e. difficulty in the opening operation).

In the above arrangement, it is preferable that the zipper tape includes a reinforcing portion provided to at least one of the first and second belt-shaped bases, the reinforcing portion being arranged in parallel to the stop portion and the engagement portion and configured to be in contact with the stop portion and the engagement portion when the stop portion and the engagement portion are deformed.

According to the above arrangement, since the reinforcing portion that is configured to be in contact with the stop portion and the engagement portion when the stop portion and the engagement portion are deformed is provided in parallel to the stop portion and the engagement portion, even when a large internal pressure is applied to the bag main body to apply a large force on the mutually meshed stop portion and the engagement portion, the deformation of the stop portion and the engagement portion results in contact with the reinforcing portion, so that stop portion and the engagement portion are kept from being deformed to release the meshing, thereby providing higher mating strength and high sealing performance.

Further, in the above arrangement, it is preferable that the zipper tape includes an auxiliary stop portion arranged on the first belt-shaped base in parallel to the stop portion, the auxiliary stop portion including a nail-like portion protruding toward the first nail, the engagement portion is a male mating portion comprising the second nail, and the stop portion and the auxiliary stop portion define a female mating portion configured to be mated with the male mating portion.

In the above arrangement, since the paired stop portion and the engagement portion are provided by the arrangement in which the male mating portion having the nail is configured to mate with the female mating portion having the nail, the zipper tape can be produced using a machine for producing typical male mating portion and female mating portion, so that a zipper tape capable of providing high sealing performance and easy-to-open performance can be easily produced. Further, since the male mating portion and the female mating portion are configured to mate with each other, the mutually meshed nails are less likely to be deformed to go out of meshing, thereby providing higher mating strength.

The female mating portion includes the stop portion and the auxiliary stop portion. The nail of the stop portion as a part of the female mating portion meshes with the nail (engagement portion) of the male mating portion when a force is applied to move the first belt-shaped base toward the opening (i.e. in a direction to shear the belt-shaped bases), whereby a high sealing performance between the stop portion and the male mating portion can be obtained. Further, when the male mating portion held to be mated between the stop portion and the auxiliary stop portion is disengaged, the auxiliary stop portion as a part of the female mating portion applies a resistance by, for instance, elastically deforming the held stop portion and the auxiliary stop portion, thereby preventing accidental detachment of the mating. Further, when the male mating portion (engagement portion) is mated between the stop portion and the auxiliary stop portion, higher air-tightness and liquid-tightness can be obtained as compared to an instance where the stop portion and the engagement portion are meshed.

In the above arrangement, it is preferable that the male mating portion and the female mating portion include a plurality of pairs of the male mating portion and the female mating portion.

In the above arrangement, since the plurality of pairs of the male mating portions and the female mating portions are provided, higher mating strength and high sealing performance can be obtained.

In the above, the number of the "plurality of pairs" is preferably in a range from 1 to 5, more preferably in a range from 1 to 3, especially preferably in a range from 1 to 2. When the number of the pairs is more than five, for instance, the side seal is difficult to be collapsed during the bag-making process, resulting in decrease in processability and increase in resistance during an opening operation (i.e. difficulty in the opening operation).

Further, in the above arrangement, it is preferable that the zipper tape includes an auxiliary stop portion arranged on the first belt-shaped base in parallel to the stop portion, the auxiliary stop portion including a nail-like portion protruding toward the first nail, in the plurality of pairs of the stop portion and the engagement portion, at least one of the engagement portions is defined as a male mating portion comprising the second nail and at least one of the stop portion together with the auxiliary stop portion is defined as a female mating portion that is configured to be mated with the male mating portion.

In the above arrangement, since at least one of the plurality of pairs of the stop portions and the engagement portions defines the male mating portions and the female mating portions each having the nail, a higher mating strength and high sealing performance can be obtained. Further, additional functions can be applied (e.g. by providing a liquid-tight male mating portion and female mating portion), thereby enhancing versatility.

In the above arrangement, it is preferable that the male mating portion and the female mating portion are made of soft resin, and one of the paired stop portion and the engagement portion that does not define the male mating portion and the female mating portion is made of a hard resin.

In the above arrangement, the plurality of pairs of the stop portions and the engagement portions defining the male mating portion and the female mating portion are provided by a soft resin and the stop portion and the engagement portion not serving as the male mating portion and the female mating portion are provided by a hard resin. Accordingly, the mating strength of the male mating portion and the female mating portion can be reduced to enhance the openability, while the meshing strength of the mating portion, which does not define the male mating portion or the female mating portion using the nail due to the internal pressure can be enhanced, whereby a high sealing performance can be obtained.

Examples of the soft resin includes LDPE (Low Density Polyethylene), LLDPE (Linear Low-Density PolyEthylene), and EVA (Ethylene Vinyl Acetate copolymer). The density of the LDPE, LLDPE, and EVA used herein is in a range from 910 kg/m$^3$ to 919 kg/m$^3$.

Examples of the hard resin include PP (Polypropylene), and LLDPE. Examples of the applicable polypropylene resin include homopolypropylene (H-PP), block polypropylene (B-PP), and random polypropylene (R-PP) and are not limited to one of these. The density of the LLDPE and EVA is in a range from 920 kg/m$^3$ to 940 kg/m$^3$.

In the above arrangement, it is preferable that the zipper tape includes a reinforcing portion provided to at least one of the first and second belt-shaped bases and between the plurality of pairs of the stop portion and the mating portion, the reinforcing portion being arranged in parallel to the stop portion and the engagement portion and configured to be in contact with the stop portion and the engagement portion when the stop portion and the engagement portion are deformed.

In the above arrangement, since the reinforcing portion to be in contact with the stop portion and the engagement portion when the stop portion and the engagement portion are deformed is provided between the plurality of pairs of the stop portions and the engagement portions, even when the reinforcing portion is provided to one of the pair of belt-shaped bases, the deformed stop portion and the engagement portion is in contact with the reinforcing portion, whereby the deformation of the stop portion and the engagement portion can be prevented, thereby providing high sealing performance.

In the above arrangement, it is preferable that the zipper tape includes: the male mating portion comprising the second nail and a small nail smaller than the second nail and provided on a side opposite a side from which the second nail protrudes; and the female mating portion configured to be mated with the male mating portion, the male and female mating portions being respectively provided to the first and second belt-shaped bases in parallel to the stop portion and the engagement portion.

In the above arrangement, since the nail and the small nail are provided to the male mating portion provided in parallel to the stop portion and the engagement portion, when, for instance, internal pressure is applied, the nail meshes to provide high sealing performance and, when the stop portion and the engagement portion are disengaged, the small nail meshes to apply resistance in releasing the engagement. With the above arrangement, favorable open touch can be provided and erroneous disengagement and unsealing can be prevented.

The depth of the small nail (i.e. dimension of the mutual engagement between the small nail and the nail) is, for instance, preferably 1/5 to 1/1, especially preferably in a range from 1/4 to 3/4 of the depth of the mutual engagement between the nails. When the engagement is shallower than 1/5, the accidental disengagement of the female mating portion 23A and the male mating portion 23B (described later) is difficult to be prevented.

A method according to still another aspect of the invention is a method for producing a bag body attached with a zipper tape, the zipper tape including: a first mating member comprising a first belt-shaped base attached along the opening of the bag main body, and a stop portion provided to the first belt-shaped base; and a second mating member comprising a second belt-shaped base attached along the opening of the bag main body and an engagement portion being provided on the second belt-shaped base, the stop portion being configured to be mated with the engagement portion, the method including: attaching the zipper tape to a film; and forming the film into a shape of a bag comprising the opening, in which the stop portion provided on the first belt-shaped base of the zipper tape includes a first nail protruding only to a widthwise side of the first belt-shaped base, and the engagement portion provided on the second belt-shaped base of the zipper tape includes a second nail that is configured to be engaged with the first nail, and the widthwise side of the first belt-shaped base facing a periphery of the film corresponding to the opening is attached to the film such that the first nail protrudes toward the periphery of the film corresponding to the opening.

In the above aspect of the invention, only the widthwise side of the first belt-shaped base near the opening is attached to the bag main body while the nail is located close to the opening of the bag main body. With the above arrangement (i.e. a so-called cantilever arrangement in which only one side of the first belt-shaped base is attached), when being applied, the internal pressure acts on the first belt-shaped base so that the first belt-shaped base is moved toward the opening (i.e. in a shear direction to move the first and second belt-shaped bases), where the internal pressure acts between the bag main body and the first belt-shaped base and a part of the internal pressure acts on the mating portion. Accordingly, the shear direction of the belt-shaped bases is aligned in a direction for the nails of the mating portions to be meshed with each other, thereby providing high sealing performance. In addition, in order to disengage the mating portions, it is only necessary to separate a side of the bag main body near the opening to keep the nails of the mating portion from being meshed, thereby easily unsealing the tape.

BRIEF DESCRIPTION OF DRAWING(S)

DESCRIPTION OF EMBODIMENT(S)

Exemplary embodiment(s) of the invention will be described below with reference to the attached drawings.

It should be noted that, though a bag body attached with a zipper tape in the first exemplary embodiment is exemplarily provided in a form of a bag body for packaging various articles including food, medicine, medical products, stationeries, and miscellaneous goods, these examples of the articles to be packaged are not exhaustive.

Structure of Bag Body

Figure 1:
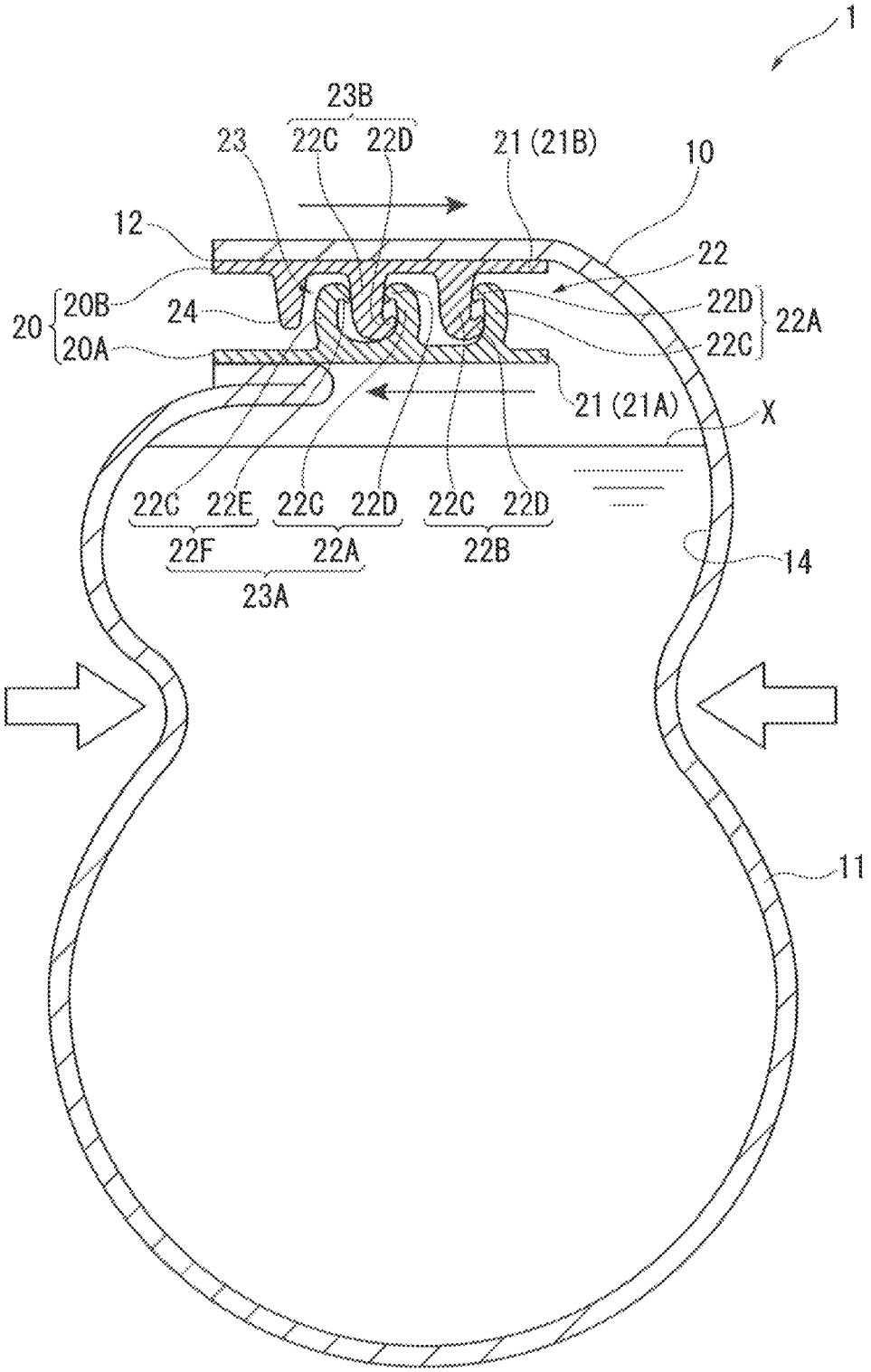
FIG. 1 is a cross sectional view showing a bag body applied with an internal pressure according to a first exemplary embodiment of the invention.

As shown in FIG. 1, a zipper-tape-attached bag body 1 (referred to as a bag body 1 hereinafter) includes a bag main body 10, and a zipper tape 20 heat-sealed to an inner surface of the bag main body 10.

The bag main body 10 is produced from a base film 11 (film) that is folded to be layered, where side seals (not shown) are formed at layered peripheries (corresponding to both sides in a folding direction). The layered peripheries of the bag main body 10 corresponding the ends in the folding direction define an edge of an opening 12, to which the zipper tape 20 is attached, to define a containing space 14 thereinside.

A single-layered or multi-layered film provided by a thermoplastic resin such as a linear low-density polyethylene (LLDPE) and polypropylene (PP) is applicable for the base film 11. A biaxially-oriented polypropylene (OPP), biaxially-oriented polyethylene terephthalate (OPET), biaxially-oriented nylon (ONy), cast polypropylene (CPP) and the like are applicable for a surface material of the multilayered film. The multilayered film may include an inorganic layer provided by aluminum vapor deposition, aluminum foil lamination and the like for the purpose of a so-called gas barrier, light shielding and the like.

Though any packaging bag material may be used as the base film 11, the base film 11 preferably have a thickness in a range from, for instance, 10 μm to 200 μm. When the thickness is less than 10 μm, sealing strength and bag strength may sometimes be weakened. On the other hand, when the thickness exceeds 200 μm, the bag may sometimes be difficult to be opened.

Figure 2:
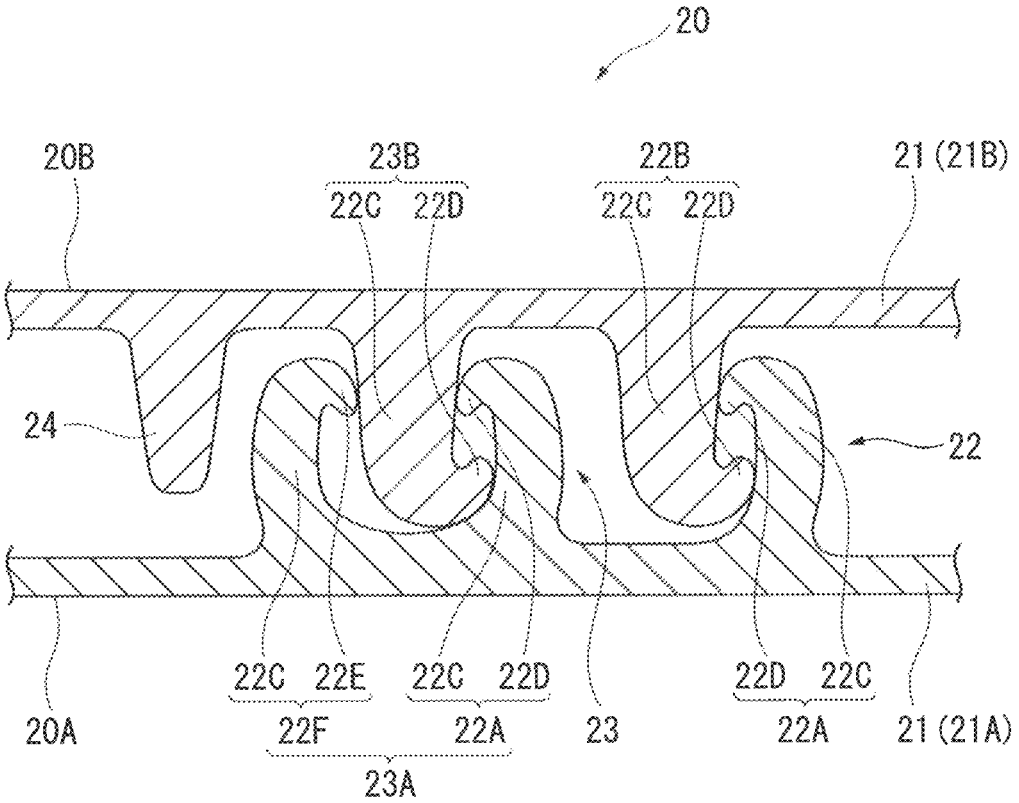
FIG. 2 is a cross sectional view showing a part of a zipper tape according to the first exemplary embodiment.

As shown in FIGS. 1 and 2, the zipper tape 20 includes a pair of belt-shaped bases 21 (21A, 21B), and a paired mating portions 22, 23 provided to each of the belt-shaped bases 21 (21A, 21B) and configured to be mutually engaged and disengaged. The mating portions 22, 23 are provided by a plurality of pairs of mating portions, specifically, two pairs of the first mating portion 22 and the second mating portion 23.

The belt-shaped bases 21 are in a form of an elongated band. One of the belt-shaped bases 21 (first belt-shaped base 21A) is adhered to the bag main body 10 along the opening 12 only at a widthwise side near the opening 12. The whole surface of the second belt-shaped base 21B is adhered to the bag main body 10.

The first mating portion 22 includes a pair of hooks 22A, 22B (stop portion and engagement portion of the invention) having the same shape that are respectively provided to each of the belt-shaped bases 21A, 21B, the hooks 22A, 22B being configured to be disengageably meshed with each other. Each of the hooks 22A, 22B includes a protrusion 22C protruded from the belt-shaped base 21 to define a wall in a longitudinal direction, and a nail 22D protruded from a leading end of the protrusion 22C toward a first side in the longitudinal direction, the hooks 22A, 22B providing a fishhook-shaped cross section.

It should be noted that the nail 22D of the hook 22A (stop portion) protrudes only toward the opening 12. In other words, the belt-shaped base 21A is adhered to the bag main body 10 so that the nail 22D protrudes toward the opening 12. Further, the hook 22B (engagement portion) protrudes only toward an inside of the bag main body 10 to be capable of being meshed with the hook 22A.

The second mating portion 23 is provided in parallel with the first mating portion 22. The second mating portion 23 includes a male mating portion 23B having the same shape as the hook 22A and a female mating portion 23A having a concave cross section and capable of being disengageably mated with the male mating portion 23B. The female mating portion 23A includes the hook 22A and an auxiliary stop portion 22F that is provided in parallel with the hook 22A and includes the protrusion 22C and a nail-like portion 22E protruding from a leading end of the protrusion 22C toward the nail 22D of the hook 22A (i.e. toward an interior of the bag main body 10). The hook 22A and the auxiliary stop portion 22F of the female mating portion 23A define a concave groove. The female mating portion 23A is provided on the first belt-shaped base 21A. The male mating portion 23B is provided on the second belt-shaped base 21B.

The nail 22D (stop portion) of the hook 22A as a part of the female mating portion 23A meshes with the nail 22D (engagement portion) of the male mating portion 23B when a force is applied to move the first belt-shaped base 21A toward the opening 12 (i.e. in a direction to shear the belt-shaped base 21A along the belt-shaped base 21A), whereby a high sealing performance between the hook 22A and the male mating portion 23B can be obtained. Further, when the male mating portion 23B held to be mated between the hook 22A and the auxiliary stop portion 22F is disengaged, the auxiliary stop portion 22F as a part of the female mating portion 23A applies a resistance by, for instance, elastically deforming the held flange 22A and the auxiliary stop portion 22F (see FIG. 3), thereby preventing accidental detachment of the mating. Further, when the male mating portion 23B (engagement portion) is mated between the hook 22A and the auxiliary stop portion 22F, higher air-tightness and liquid-tightness can be obtained as compared to an instance where the hook 22A and the hook 22B are meshed.

The first mating portion 22 and the second mating portion 23 are so arranged that, when a predetermined distance (e.g. a thickness (axial width dimension) of the first mating portion 22 in a direction along a surface of the belt-shaped base 21) is defined as 1, the distance between the first mating portion 22 and the second mating portion 23 is preferably in a range from 1 to 5, more preferably 1 to 3, especially preferably in a range from 1 to 2. When the distance is larger than 5, the first mating portion 22 and the second mating portion 23 are likely to be deformed due to unexpected external force to be easily disengaged.

With the above arrangement, the first mating portion 22 and the second mating portion 23 can be reliably engaged and disengaged and can be prevented from being accidentally disengaged.

Further, the second belt-shaped base 21B is provided with the reinforcing portion 24 that projects in a manner similar to the protrusion 22C to form a rib is provided in parallel with the first mating portion 22 and the second mating portion 23.

The height of the reinforcing portion 24 is defined to be in a range from 1/5 to 1/1, more preferably 1/3 to 1/1 with respect to a gap between the belt-shaped bases 21A, 21B when the first mating portion 22 and the second mating portion 23 are mated. Though detailed later, when the height is smaller than 1/5, the reinforcing portion 24 cannot prevent the adjacent second mating portion 23 from being disengaged. On the other hand, when the engagement state is deeper than 1/1, it is likely to be difficult to mate the adjacent second mating portion 23.

Further, the width of the reinforcing portion 24 (i.e. the thickness of the reinforcing portion 24 in a direction from the containing space 14 to the opening 12) is preferably in a range from 200 μm to 1000 μm, more preferably in a range from 250 μm to 500 μm, especially preferably in a range from 250 μm to 400 μm. When the width is narrower than 200 μm, resistance against a force generated in the shear direction (i.e. the direction along the surface of the belt-shaped base 21) may become insufficient.

Further, the gap between the reinforcing portion 24 and the adjacent second mating portion 23 is preferably in a range from 0 to 2, more preferably in a range 0 to 1, supposing that the thickness (i.e. the 4 axial width dimension) of the reinforcing portion 24 in a direction along the surface of the belt-shaped base 21 is 1. If the gap is larger than 2, the second mating portion 23 may not interfere with the reinforcing portion 24 when a force is applied in the shear direction, so that no reinforcing effect may be obtained.

The zipper tape 20 includes: a female tape 20A including the first belt-shaped base 21A, and the female mating portion 23A provided by the hook 22A (stop portion) and the stop portion, the female mating portion 23A being provided on the first belt-shaped base 21A; and a male tape 20B including the second belt-shaped base 21B, the hook 22B (engagement portion), the male mating portion 23B (engagement portion) and the reinforcing portion 24, the hook 22B, the male mating portion 23B and the reinforcing portion 24 being provided on the second belt-shaped base 21B. The female tape 20A and the male tape 20B are engaged and disengaged to open/close the opening 12.

The zipper tape 20 is provided using, for instance, a polyolefin resin. It should be noted that the zipper tape 20 may have shape-retention properties (i.e. adapted to keep the shape thereof when being bent in a longitudinal direction).

Preferable examples of the polyolefin resin include polyethylene resin such as low-density polyethylene and linear low-density polyethylene and polypropylene resin. Especially, inherently stretch-resistant polypropylene resin is preferable. Examples of the applicable polypropylene resin include homopolypropylene (H-PP), block polypropylene (B-PP), random polypropylene (R-PP), and propylene-ethylene-butene 1 random ternary copolymer.

Production Method of Packaging Bag

Next, a production method of the above bag body 1 will be described below.

When the bag body 1 is to be produced, the zipper tape 20 with the female tape 20A and the male tape 20B thereof being mated with each other is bonded along a periphery in a feeding direction of the base film 11 being fed. When the zipper tape 20 is bonded, the belt-shaped base 21B of the male tape 20B is heat-sealed to the base film 11. The whole surface of the belt-shaped base 21B is bonded to the base film 11 by the heat-sealing.

Subsequently, both edges of the base film 11 are superposed and the base film 11 overlapped on the female tape 20A is heat-sealed to the female tape 20A. At the heat-sealing, only one of the peripheral ends of the base film 11 corresponding to the opening 12 (i.e. one of the peripheral ends of the base film 11 near an end of the belt-shaped base 21A toward which the nail 22D projects) is bonded. It should be noted that, since the reinforcing portion 24 is located corresponding to the heat-sealed position, the base film 11 and the first belt-shaped base 21A are brought into close contact with each other when the base film 11 is heat-sealed, whereby favorable heat-sealing can be obtained.

Then, after the zipper tape 20 is point-sealed at a predetermined interval (i.e. a distance between the side seals) to collapse the first mating portion 22 and the second mating portion 23 of the zipper tape 20, the base film 11 is heat-sealed at a predetermined distance in a direction orthogonal to the feeding direction of the base film 11 to form the side seal and is cut at the position of the side seal to provide the bag body 1.

After a predetermined amount of contents X is fed in the obtained bag body 1, the base film 11 is heat-sealed using a side seal bar in a direction orthogonal to the feeding direction of the base film 11 to form the side seal.

Figure 3:
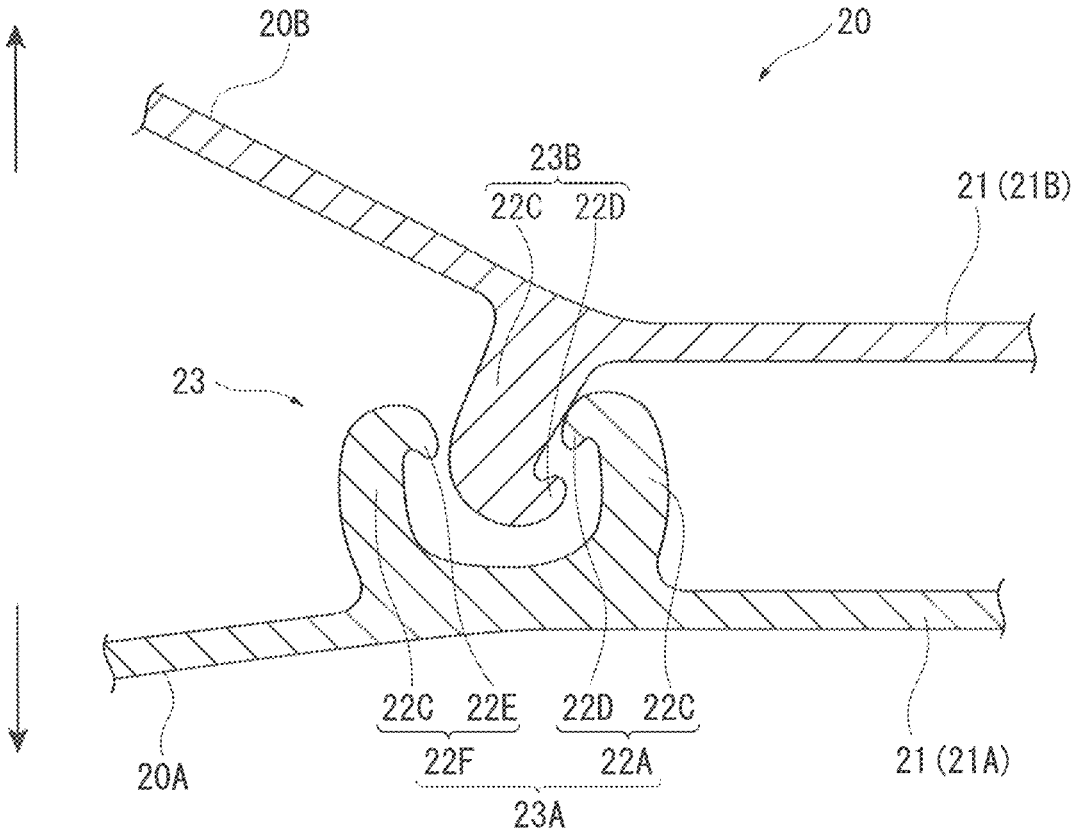
FIG. 3 is a cross sectional view showing how meshed nails are released in an opening operation according to the first exemplary embodiment.

Further, after the second side seal is formed to enclose the contents X (see FIG. 1), the edge of the opening 12 of the bag body 1 is pulled in a direction indicated by arrows in FIG. 3 (i.e. in a direction away from each other) in order to unseal the opening 12. Thus, the nail 22D of the male mating portion 23B and the nail 22D of the female mating portion 23A are moved in disengaging directions, where the mating of the second mating portion 23 is released while an end of the male mating portion 23B slides on the nail-like portion 22E of the female mating portion 23A. Similarly, in the first mating portion 22, the nail 22D of the hook 22A and the nail 22D of the hook 22B are moved in disengaging directions, and the hooks 22A, 22B are disengaged, whereby the opening 12 can be unsealed with a small opening force.

The contents X are delivered through the unsealed opening 12 and the first mating portion 22 and the second mating portion 23 are again mated to reclose the bag.

Figure 4:
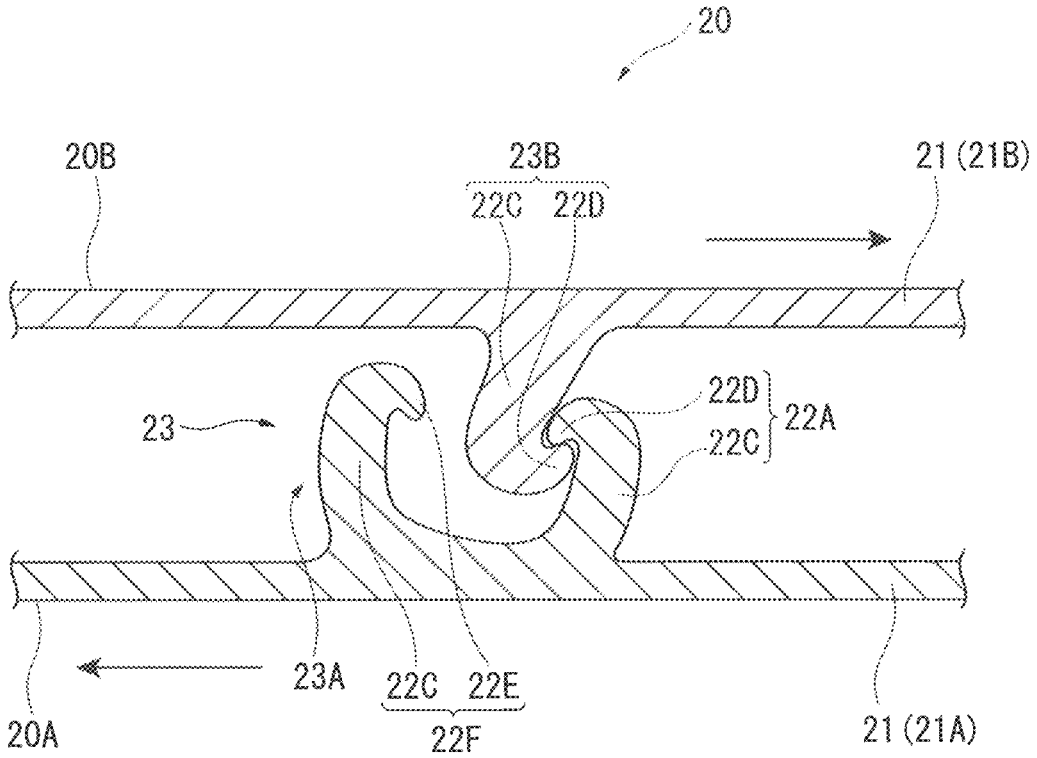
FIG. 4 is a cross sectional view showing how the nails are meshed when the internal pressure is applied according to the first exemplary embodiment.

When an external force acts on the bag body 1 to increase an internal pressure while the bag containing the contents X is sealed as shown in FIG. 1, the female tape 20A and the male tape 20B displace in direction indicated by arrows in FIGS. 1 and 4. In this condition, the nail 22D of the female mating portion 23A and the nail 22D of the male mating portion 23B, and the nail 22D of the hook 22A and the nail 22D of the hook 22B are pulled by and meshed with each other. Thus, the mating between the first mating portion 22 and the second mating portion 23 is enhanced, so that the opening 12 is kept closed. It should be noted that a part of the increased internal pressure acts between the bag main body 10 and the belt-shaped base 21A of the female tape 20A and the rest of the internal pressure acts on the mating portion of the female tape 20A and the male tape 20B, whereby the internal pressure directly acts to prevent the mated female tape 20A and the male tape 20B from being disengaged.

Advantage(s) of Embodiment(s)

In the above exemplary embodiment, only the widthwise side of the first belt-shaped base 21A near the opening 12 of the bag main body 10 is attached to the bag main body 10, the nail 22D protruding only toward the opening 12 is provided to the first belt-shaped base 21A, and the nail 22D protruding only toward an interior of the bag main body 10 is provided to the second belt-shaped base 21B, in which the nails 22D, 22D are mutually engageable/disengageable.

With the above arrangement (i.e. a so-called cantilever arrangement in which only one side of the first belt-shaped base 21A is attached), when being applied, the internal pressure acts so that the first belt-shaped base 21A is moved toward the opening 12 (i.e. in a direction along the first belt-shaped base 21A to shear the belt-shaped bases). Thus, the internal pressure acts between the bag main body and the first belt-shaped base and a part of the internal pressure acts on the mating portion. Thus, the force acting in a direction for shearing the belt-shaped bases acts in a direction for the nails 22D, 22D of the first mating portions 22 and the nails 22D, 22D of the second mating portion 23 to be mutually meshed, thereby providing high sealing performance. On the other hand, when the mating is released to unseal the bag, it is only necessary to separate sides of the bag main body 10 near the opening 12, in order to release the meshing of the nails 22D, 22D, so that the bag can be easily unsealed.

Two pairs of the mating portions (i.e. the first mating portion 22 and the second mating portion 23) are provided.

With the above arrangement, the mating strength can be enhanced without increasing the opening force, so that high sealing performance can be obtained without significantly impairing the openability.

The second mating portion 23 includes the female mating portion 23A and the male mating portion 23B.

Accordingly, when an external force is applied to displace the female tape 20A and the male tape 20B in directions respectively opposite to the direction in which the female tape 20A and the male tape 20B are displaced is applied when the internal pressure of the bag body 1 is increased, since maintainability of the mating of the second mating portion 23 is higher than that of the first mating portion 22, accidental unsealing of the bag can be avoided. Further, the female mating portion 23A can be designed in the same shape as that of a typical zipper tape and thus a die for producing the zipper tape 20 can be readily prepared, thereby enhancing the productivity thereof.

Since the reinforcing portion 24 is provided at a part of the second belt-shaped base 21B corresponding to the heat-sealed portion of the first belt-shaped base 21A to the base film 11, when a force in a shearing direction is applied to the adjacent second mating portion 23 to deform the second mating portion 23, the second mating portion 23 interferes with the reinforcing portion 24 to increase resistance against releasing the mating of the second mating portion 23 to provide high sealing performance.

When an external force is applied to displace the female tape 20A and the male tape 20B in directions respectively opposite to the direction in which the female tape 20A and the male tape 20B are displaced is applied when the internal pressure of the bag body 1 is increased, the female mating portion 23A is pushed by the male mating portion 23B to be deformed toward the opening and brought into contact with the reinforcing portion 24, whereby disengagement of the male mating portion 23B can be avoided.

Modification(s)

It should be noted that, though the best arrangement and the like for implementing the invention is disclosed in the above, the scope of the invention is not limited thereto. In other words, while the invention has been particularly explained mainly in relation to a specific embodiment, a person skilled in the art could make various modifications in terms of material, quantity or other particulars to the above described embodiment without deviating from the technical idea or any object of the present invention.

Accordingly, any descriptions of the material or layer arrangement or the like disclosed above are given as examples to enable easy understanding of the invention, and do not limit the invention, so that descriptions using names of components, with any such limitations of the material or the like removed in part or whole, are included in the invention.

Figure 5:
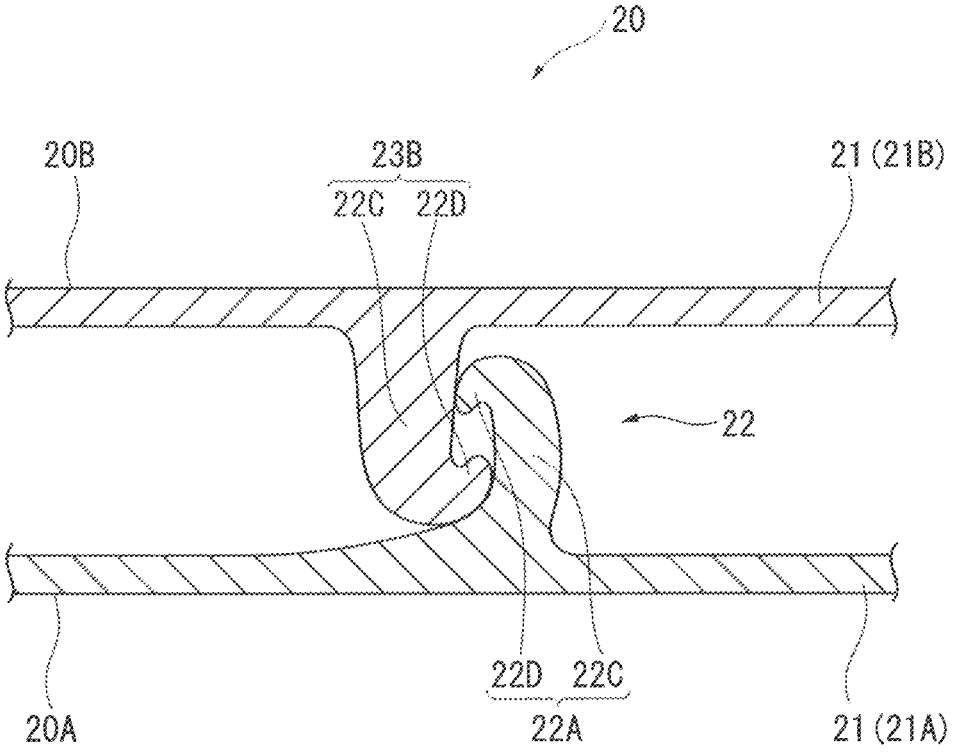
FIG. 5 is a cross sectional view showing a part of a zipper tape according to a modification of the exemplary embodiment.

For instance, though the first mating portion 22 and the second mating portion 23 are provided in the above exemplary embodiment, the first mating portion 22 may solely be provided as shown in FIG. 5. With the simple arrangement shown in FIG. 5, the productivity can be enhanced.

Figure 6:
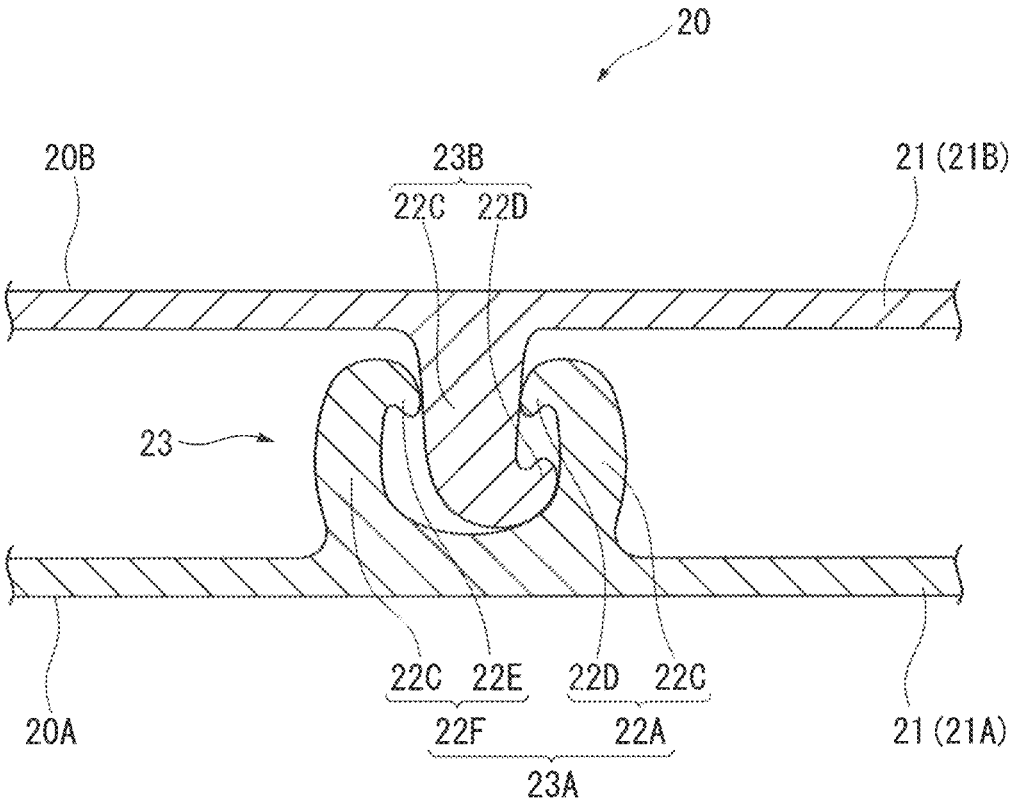
FIG. 6 is a cross sectional view showing a part of a zipper tape according to another modification of the exemplary embodiment.

Alternatively, as shown in FIG. 6, the second mating portion 23 may solely be provided. In the arrangement shown in FIG. 6, since the nail-like portion 22E projecting only toward the containing space 14 is provided at an end of the male mating portion 23B, the engagement of the male mating portion 23B at the time of unsealing is weak and thus the bag can be easily unsealed. In addition, when an internal pressure in a direction for shearing the female belt-shaped base 23A is applied, the nails 22D, 22D are strongly engaged to provide high sealing performance. Further, the structure is simple and the productivity can be enhanced.

Figure 7:
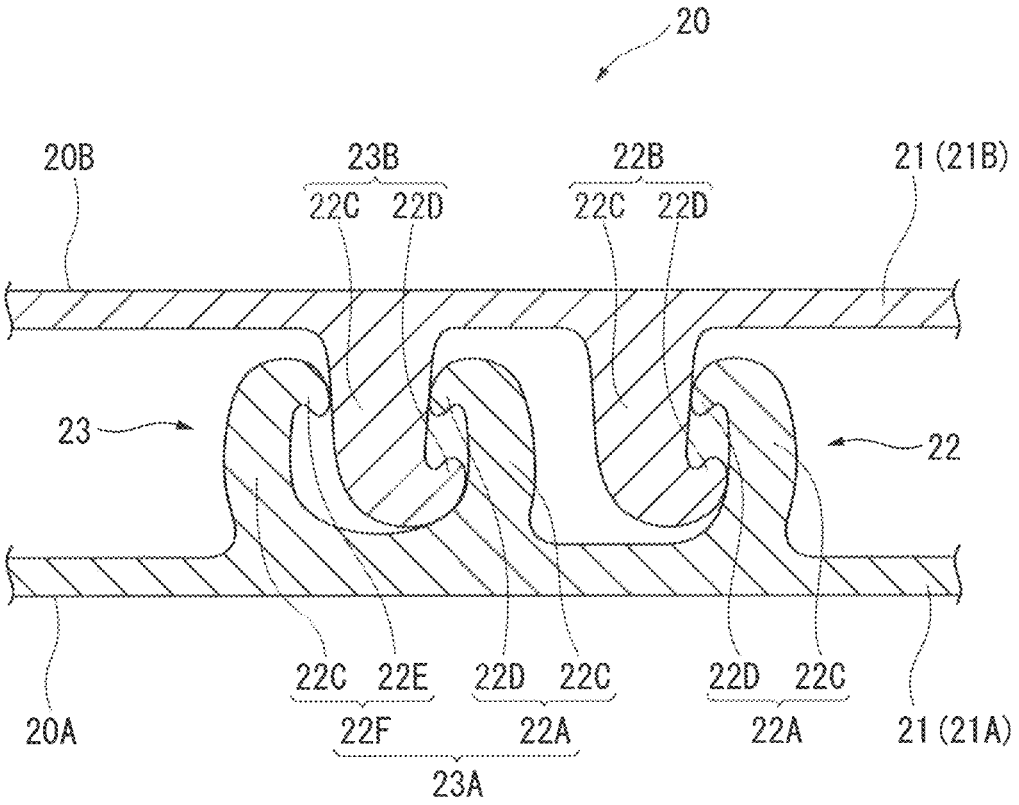
FIG. 7 is a cross sectional view showing a part of a zipper tape according to still another modification of the exemplary embodiment.

Alternatively, as shown in FIG. 7, it is not necessary to provide the reinforcing portion 24. Since the pair of female mating portion 23A and the male mating portion 23B are provided in the arrangement shown in FIG. 7 in addition to the arrangement shown in FIG. 6, high sealing performance against internal pressure can be further enhanced while keeping the easy openability of the arrangement shown in FIG. 6.

Figure 8:
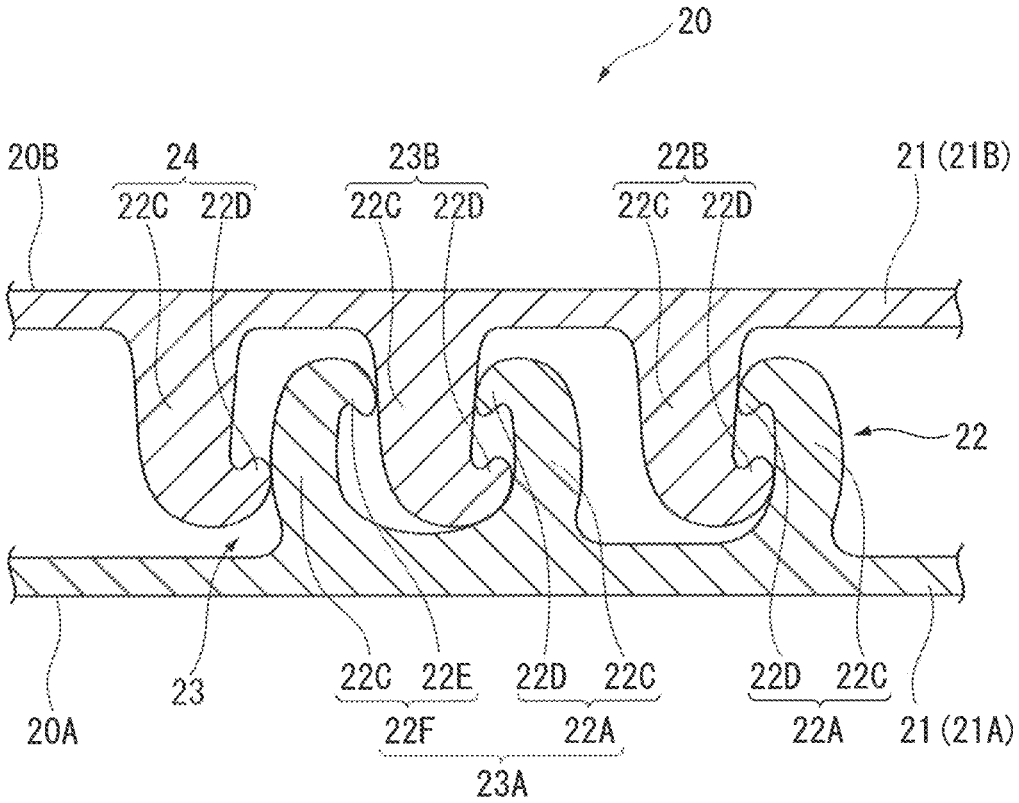
FIG. 8 is a cross sectional view showing a part of a zipper tape according to a further modification of the exemplary embodiment.

Alternatively, as shown in FIG. 8, the reinforcing portion 24 may have the same shape as the hook 22B. In the arrangement shown in FIG. 8, the hooks 22B having the same shape are provided on the male tape 20B, so that the die can be easily produced and productivity can be enhanced. Further, the nail 22D at a leading end of the reinforcing portion 24 can be easily positioned to be in contact with or close to the female mating portion 23A, so that the deformation of the female mating portion 23A can be prevented, thereby allowing further firm mating of the mating portions. Further, since the nail 22D is provided to the reinforcing portion 24, whether or not the zipper tape 20 is mated can be easily determined based on a hand touch.

Figure 9:
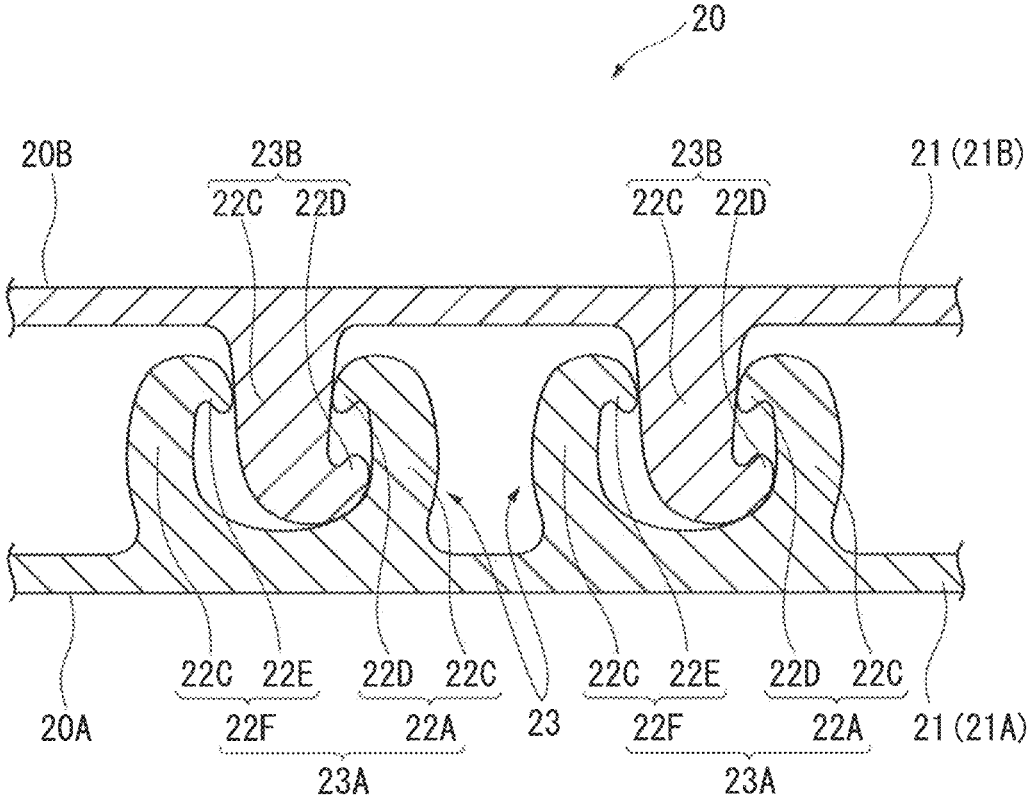
FIG. 9 is a cross sectional view showing a part of a zipper tape according to a still further modification of the exemplary embodiment.

Alternatively, as shown in FIG. 9, a plurality of (e.g. two) pairs of the second mating portions 23 may be provided. According to the arrangement shown in FIG. 9, the male mating portion 23B can be kept from being accidentally disengaged from the female mating portion 23A and higher sealing performance against internal pressure can be obtained.

A plurality of pairs of the first mating portion 22 may be provided.

When a plurality of the pairs of the mating portions 22, 23 are provided, the number of the pairs of the mating portions are preferably in a range from 1 to 5, more preferably in a range from 1 to 3, especially preferably in a range from 1 to 2. This is because, when more than five pairs are provided, collapsing of the side seal during the bag formation becomes difficult, thereby reducing processability and increasing the unsealing resistance (i.e. difficult to open the bag).

Figure 10:
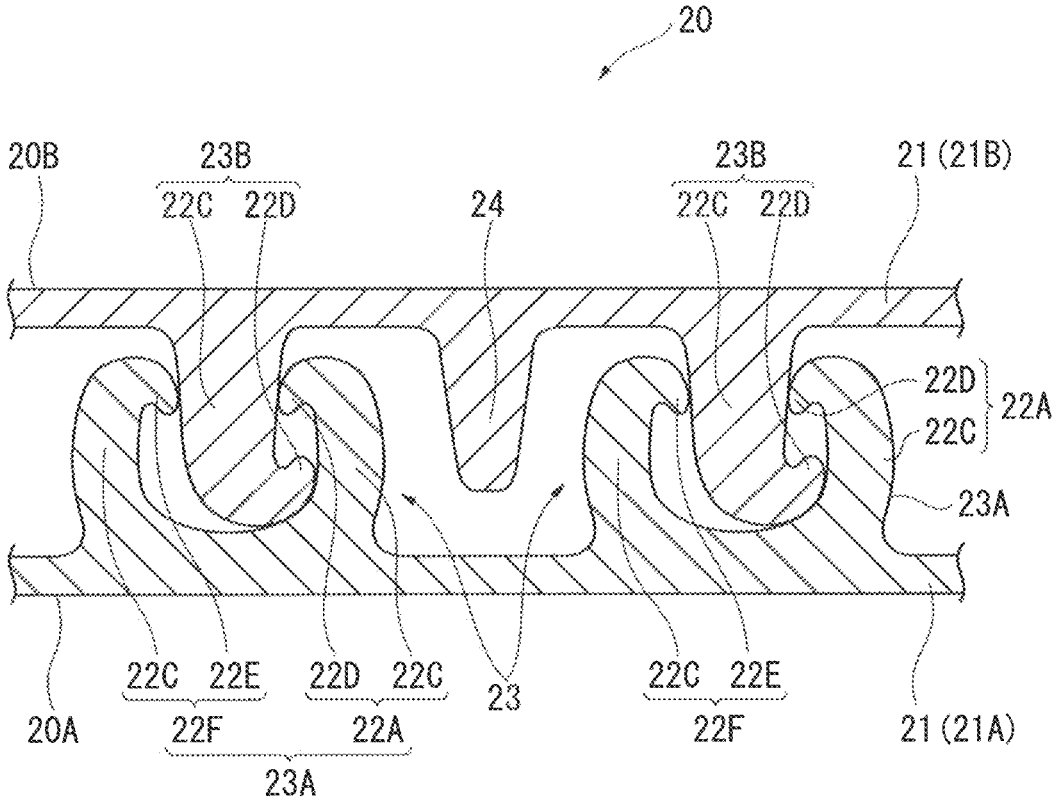
FIG. 10 is a cross sectional view showing a part of a zipper tape according to a still further modification of the exemplary embodiment.

Alternatively, the reinforcing portion 24 may be provided between the plurality of pairs of the mating portions, specifically between two pairs of the second mating portions 23 as shown in FIG. 10. In the arrangement shown in FIG. 10, the female mating portion 23A is brought into contact with the reinforcing portion 24 in accordance with the deformation thereof, whereby the female mating portion 23A can be kept from being greatly deformed. Accordingly, the nails 22D, 22D can keep the rigid mating therebetween, and the female mating portion 23A can be kept from accidentally disengaged from the male mating portion 23B.

Figure 11:
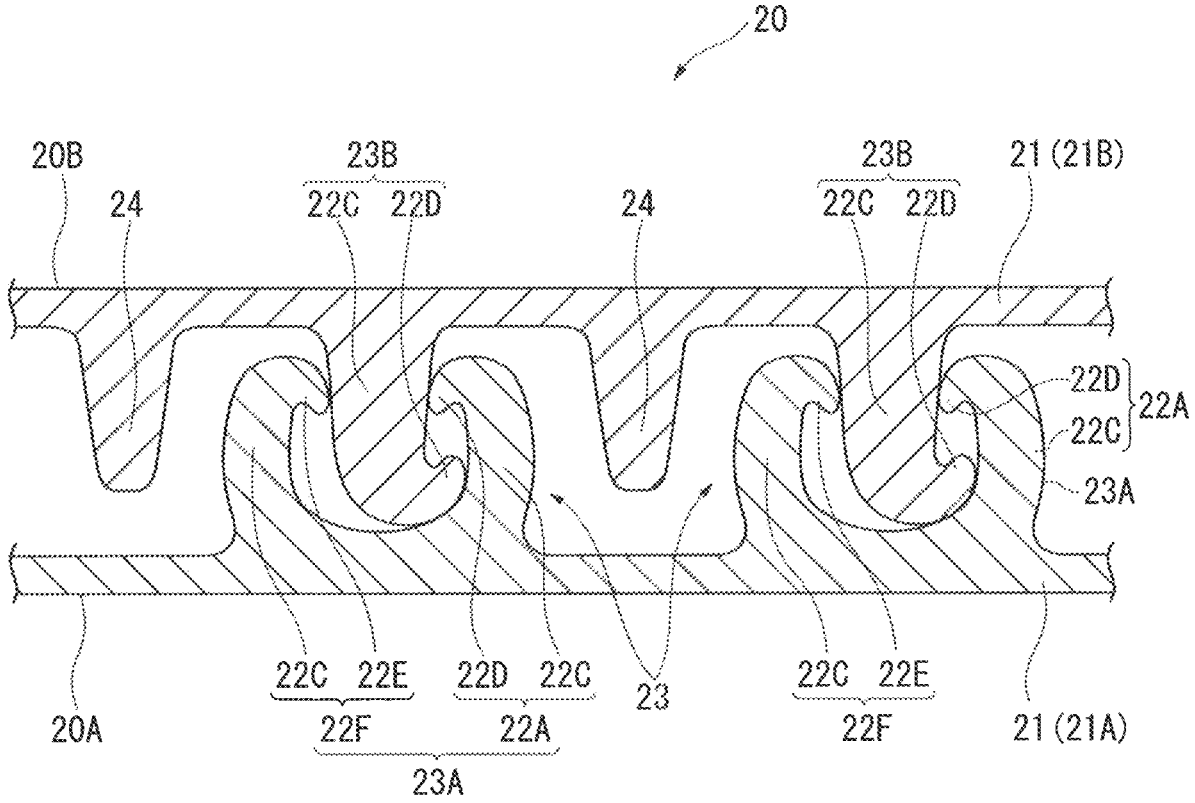
FIG. 11 is a cross sectional view showing a part of a zipper tape according to a still further modification of the exemplary embodiment.

Further, a plurality of (e.g. two as shown in FIG. 11) pairs of the reinforcing portion 24 may be provided. In the arrangement shown in FIG. 11, when a force in the shearing direction acts on the female belt-shaped base 21A, the nails 22D can be more firmly meshed with each other due to the presence of the reinforcing portion 24, thereby exhibiting higher sealing performance.

It should be noted that, when the number of the plurality of pairs of the reinforcing portion 24 corresponds to the number of the plurality of pairs of the mating portions, accidental release of the mating portions, and consequently, accidental unsealing can be prevented.

Figure 12:
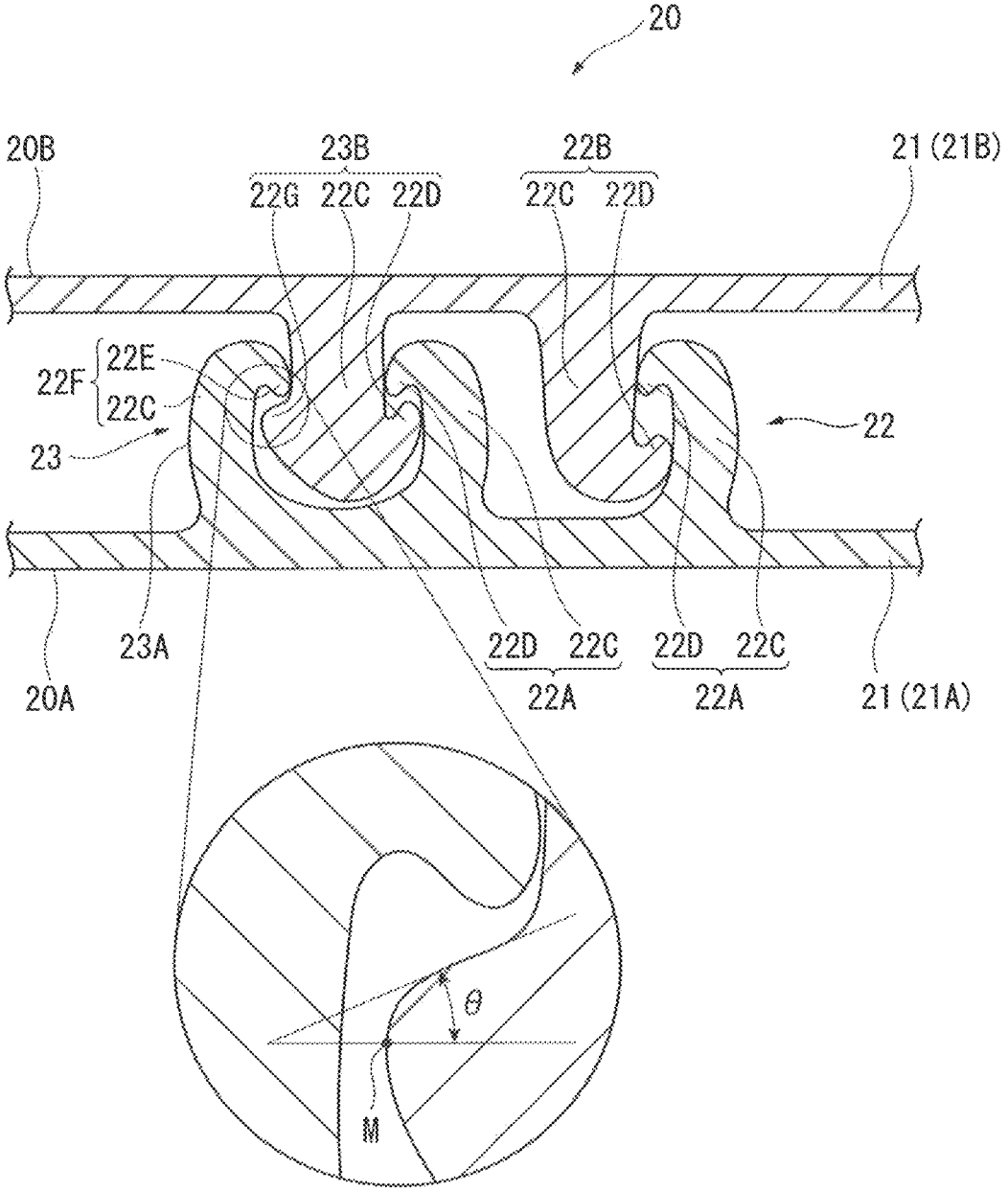
FIG. 12 is a cross sectional view showing a part of a zipper tape according to a still further modification of the exemplary embodiment.

Further, the male mating portion 23B may include a small nail 22G that projects from a side of the male mating portion 23B opposite the nail 22D toward the opening 12 by an amount smaller than the nail 22D as shown in FIG. 12 may be provided, and the small nail 22G may be engaged with and disengaged from the nail-like portion 22E provided on the female mating portion 23A and projecting toward the containing space 14. Specifically, the ratio of the depth of the mutual engagement between the small nail 22G and the nail-like portion 22E to the depth of the engagement between the nails 22D is preferably in a range from 1/5 to 1/1, more preferably in a range from 1/4 to 3/4. When the mutual engagement between the small nail 22G and the nail-like portion 22E becomes shallower than 1/5, prevention of accidental disengagement of the female mating portion 23A and the male mating portion 23B (described below) cannot be easily effected. An angle θ of an oblique line tangent to the small nail 22G with respect to a horizontal line parallel to a surface of the belt-shaped base 21 passing through a top M is preferably 0 degrees or more and less than 90 degrees in order not to impair openability while preventing the accidental opening.

In the arrangement shown in FIG. 12, since the small nail 22G is stopped by the nail-like portion 22E, the accidental disengagement of the female mating portion 23A and the male mating portion 23B can be more effectively prevented and favorable hand touch during mating and releasing operations of the zipper tape 20 can be provided.

Figure 13:
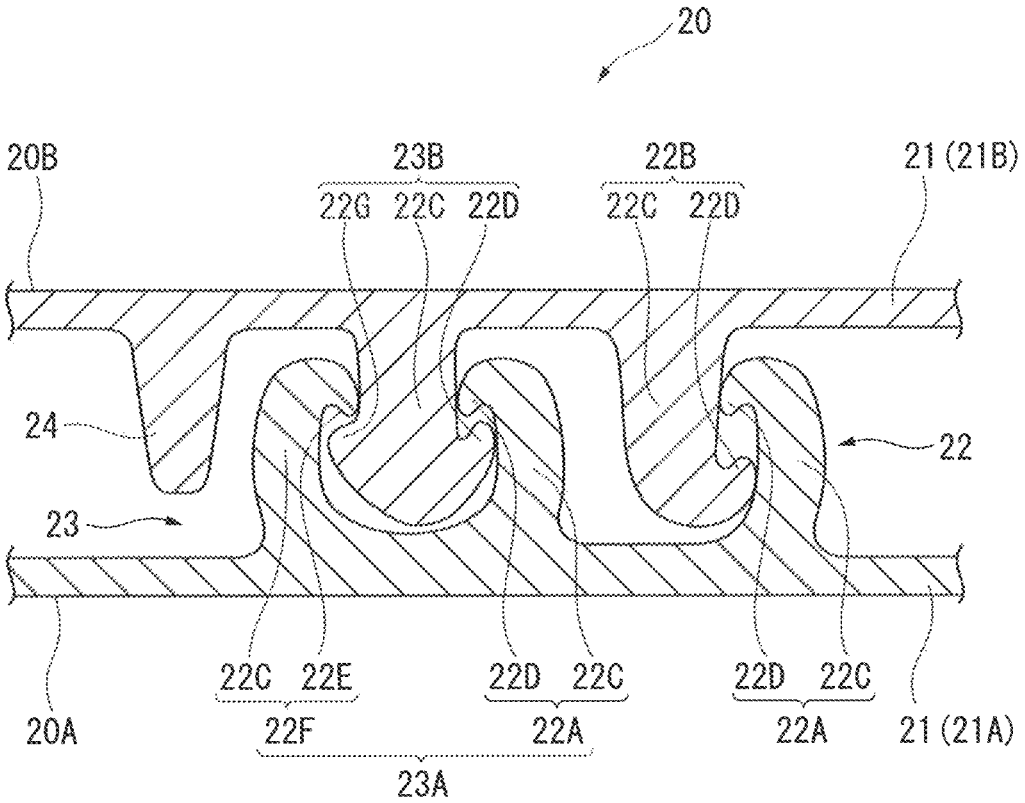
FIG. 13 is a cross sectional view showing a part of a zipper tape according to a still further modification of the exemplary embodiment.
Figure 14:
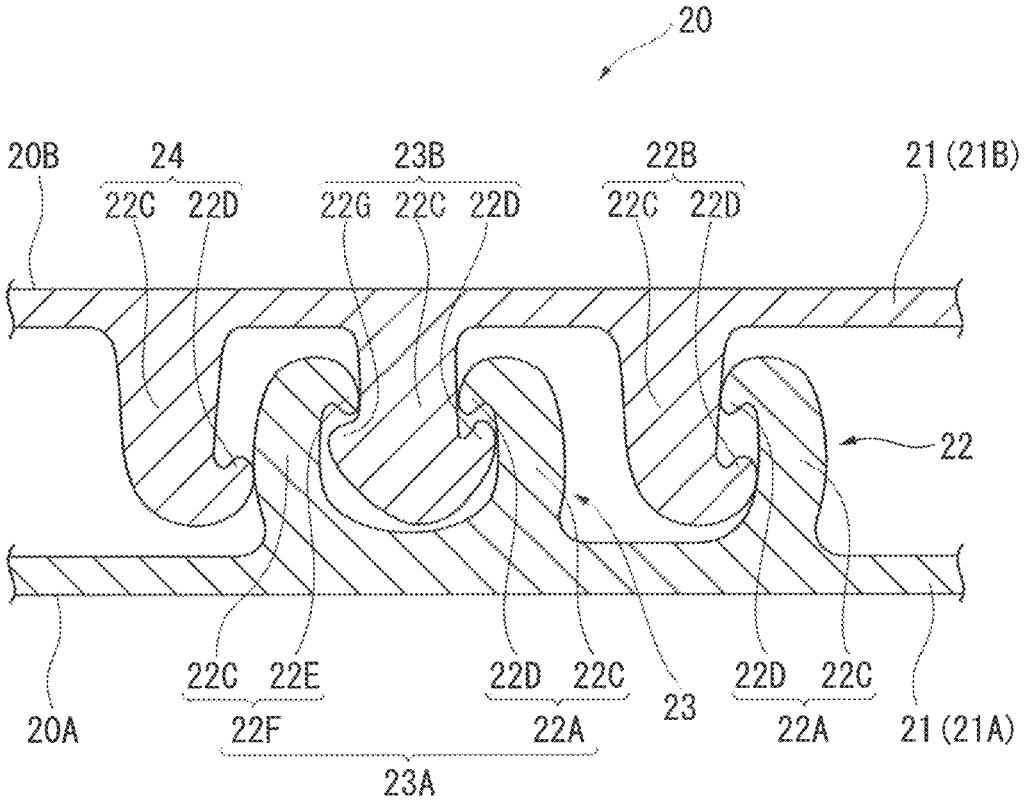
FIG. 14 is a cross sectional view showing a part of a zipper tape according to a still further modification of the exemplary embodiment.

Further, as shown in FIG. 13, the reinforcing portion 24 may be added to the arrangement shown in FIG. 12 to provide favorable hand touch during the mating and releasing operations of the zipper tape 20. In addition, as shown in FIG. 14, the reinforcing portion 24 shown in FIG. 13 may be modified to have the same shape as the hook 22B to provide favorable hand touch during the mating and releasing operations of the zipper tape 20.

Figure 15:
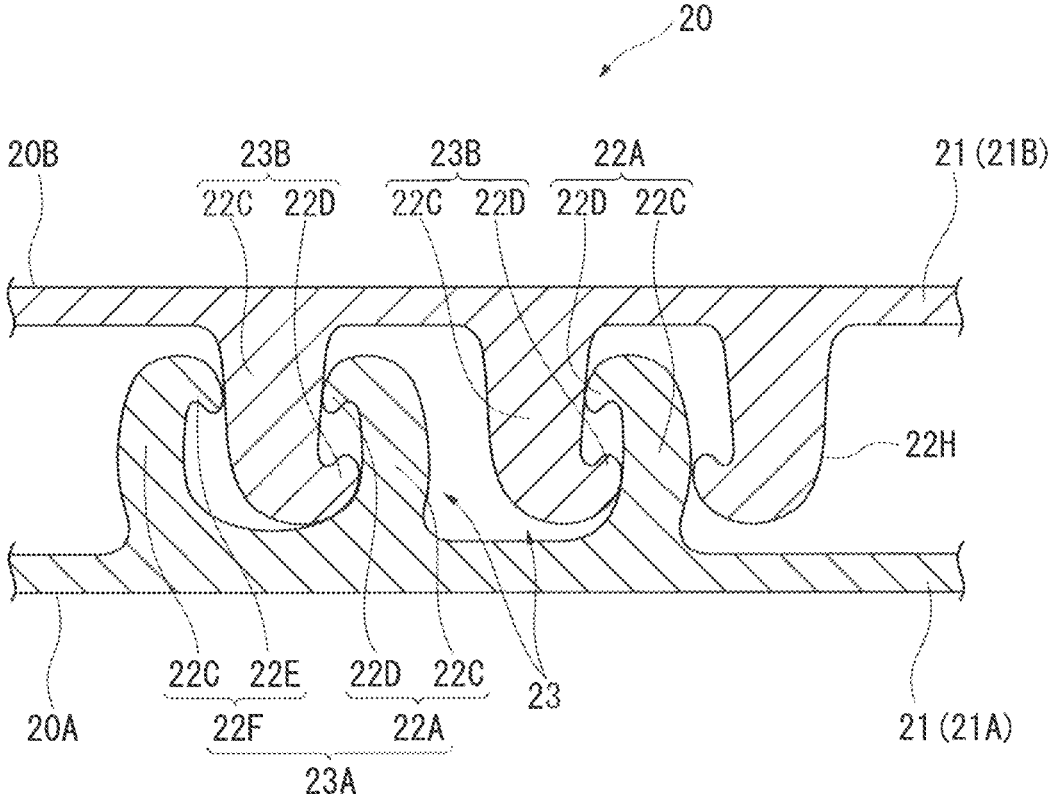
FIG. 15 is a cross sectional view showing a part of a zipper tape according to a still further modification of the exemplary embodiment.

Though the two pairs of the second mating portions 23 shown in FIG. 9 include the female mating portions 23A on the first belt-shaped base 21A and the male mating portions 23B on the second belt-shaped base 21B, the female mating portion 23A and the male mating portion 23B may be provided to each of the belt-shaped bases 21A, 21B as, for instance, shown in FIG. 15.

With the simple arrangement shown in FIG. 15, since the female tape 20A and the male tape 20B can be produced using dies of the same shape, the productivity can be enhanced. Further, since a pressing nail H disposed near the containing space 14 with respect to the hook 22A shown in FIG. 7 to serve as a reinforcing portion of the female mating portion is provided, favorable hand touch at the time of mating and releasing the zipper tape 20 can be provided.

Figure 16:
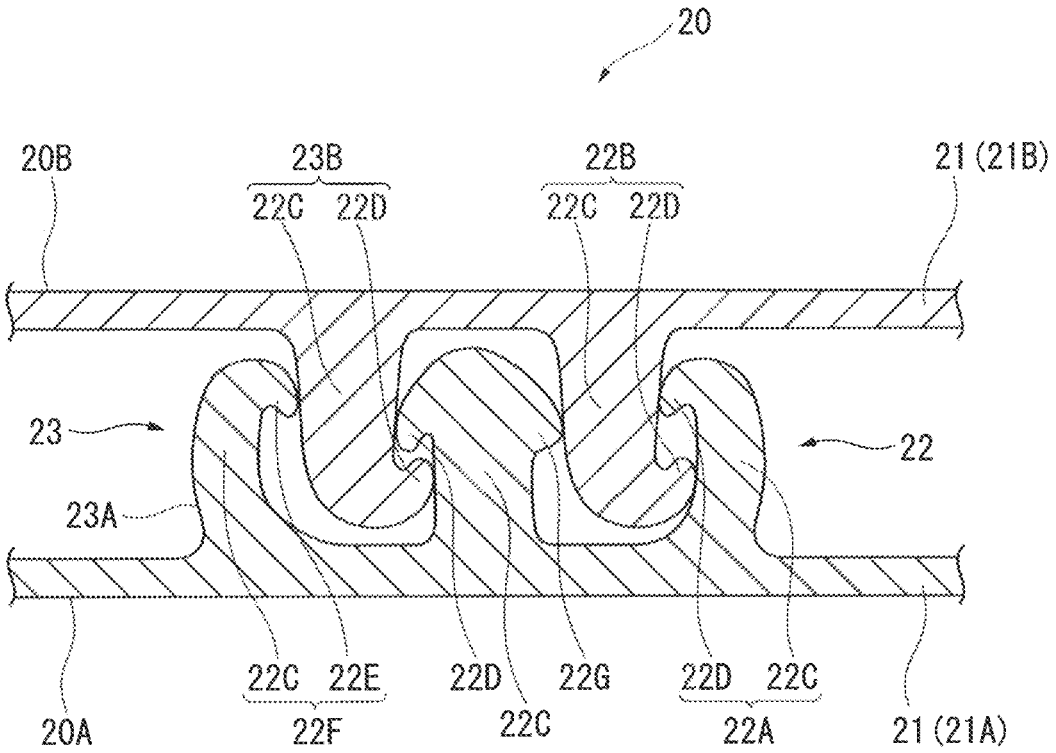
FIG. 16 is a cross sectional view showing a part of a zipper tape according to a still further modification of the exemplary embodiment.

Further, as shown in FIG. 16, in an arrangement provided with the first mating portion 22 and the second mating portion 23, the small nail 22G projecting toward the first mating portion 22 may be provided to the female mating portion 23A of the second mating portion 23, the small nail 22G being in contact with the mating hook 22B to prevent accidental disengagement, thereby providing a favorable hand touch at the time of mating and releasing operations of the zipper tape 20. The shape of the small nail 22G may be the same as the shape of the nail-like portion 22E.

Figure 17:
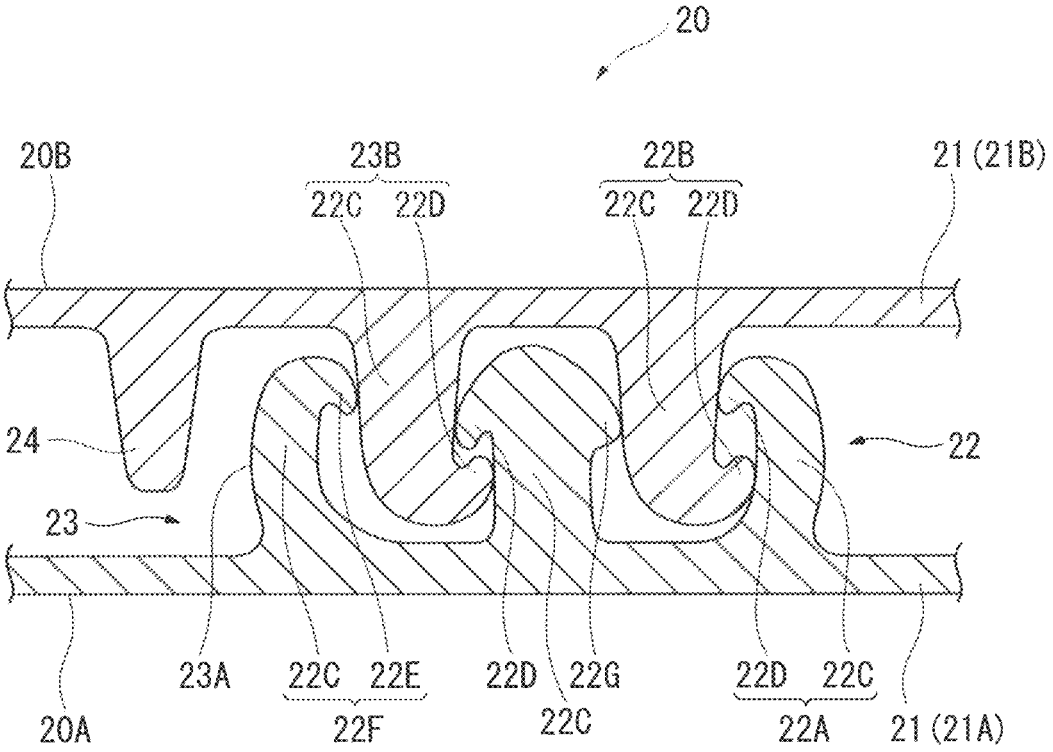
FIG. 17 is a cross sectional view showing a part of a zipper tape according to a still further modification of the exemplary embodiment.
Figure 18:
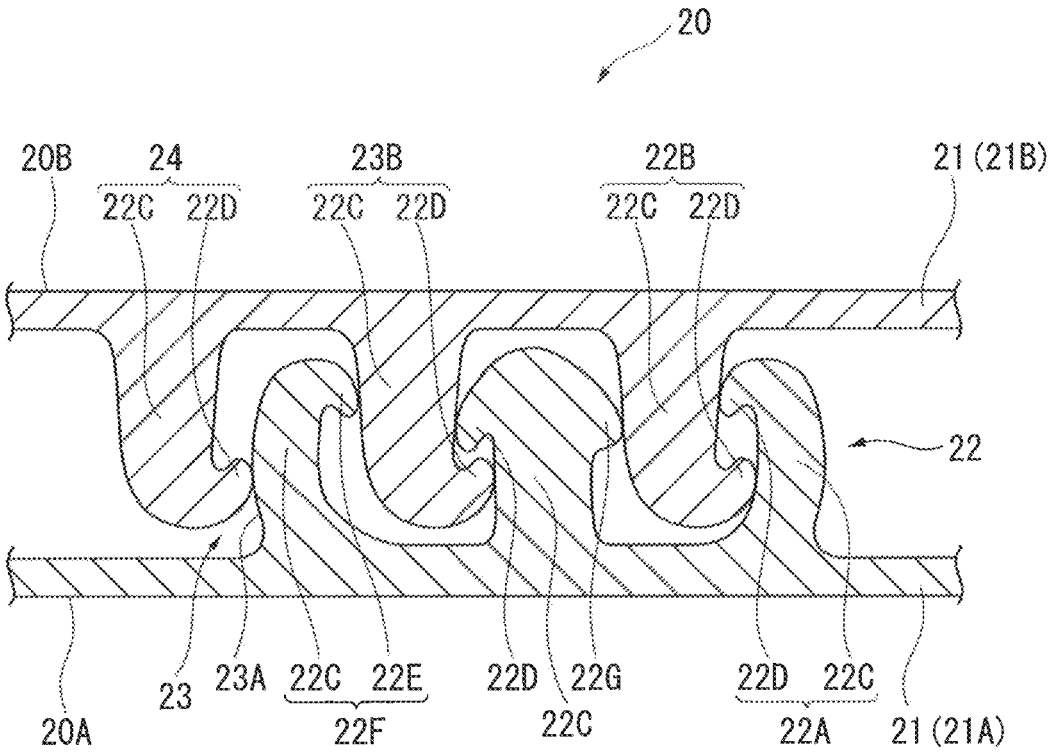
FIG. 18 is a cross sectional view showing a part of a zipper tape according to a still further modification of the exemplary embodiment.

Further, as shown in FIG. 17, the reinforcing portion 24 may be added to the arrangement shown in FIG. 16 to prevent the deformation of the female mating portion 23A by the presence of the reinforcing portion 24 when a force acts on the female belt-shaped base 21A in the shearing direction and to reinforce the engagement of the nails 22D, thereby providing higher sealing performance. Alternatively, as shown in FIG. 18, the nail 22D may be provided to the reinforcing portion 24 shown in FIG. 17 to further effectively prevent the deformation of the female mating portion 23A and to provide favorable hand touch during the mating and releasing operations of the zipper tape 20.

Though the description has been made for the arrangement in which the zipper tape is attached along the opening edge of the opening 12, any bag-making process may be employed. For instance, the opening edge of the opening 12 may be heat-sealed to provide a top seal (i.e. three-sided bag) and the top seal may be cut when the bag is to be opened. The shape of the bag body 1 may be altered as desired by, for instance, including a gusset.

In order to attach the zipper tape 20 to the bag main body 10, various methods including ultrasonic welding, adhesion using an adhesive and the like may be used in addition to heat-sealing.

The reinforcing portion 24 may be provided to both of the female tape 20A and the male tape 20B. When the reinforcing portion 24 is provided at mutually opposed positions, the height of the reinforcing portion 24 can be reduced and the molding process can be facilitated, thereby enhancing productivity.

The reinforcing portion 24 is not necessarily longitudinally continuous but may be discontinuously provided in a dotted pattern in the longitudinal direction.

EXAMPLE(S)

Next, the invention will be described in further detail below with reference to Example(s).

It should be noted that the scope of the invention is not limited by the Example(s) and Comparative Example(s) below.

Example 1

The zipper tape 20 having the shape shown in FIG. 2 was formed using a material described below. The zipper tape 20 was heat-sealed to the base film 11 described below using a three-sided-bag making machine (manufactured by TOTANI CORPORATION, product name; BH-60HV) to produce the bag body 1. The zipper tape 20 was heat-sealed only at a side of the first belt-shaped base 21A near the opening 12 as in the above exemplary embodiment(s).

Figure 19A:
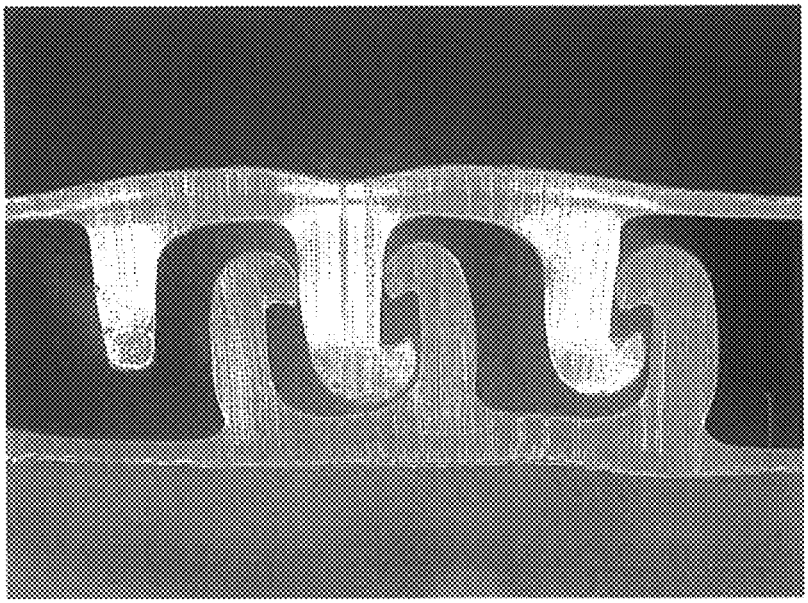
FIG. 19A is a photograph showing a state of an opening in an example for explaining the invention.

A photomicrograph of a cross section of the produced zipper tape 20 is shown in FIG. 19A.

zipper tape: polyethylene manufactured by TOSOH NIKKEMI CORPORATION, product name; T320A (density: 913 kg/m$^3$, melting point: 113 degrees C.)

It should be noted that the melting point was the maximum melting peak temperature measured using Differential Scanning Calorimetry (DSC).

base film 11: two-layer structure of a PET layer (thickness 12 μm) and an LLDPE layer (thickness 50 μm)

An opening strength in the state shown in FIG. 3 and a non-open-side mating strength shown in FIG. 4 were measured using the following methods.

Figure 20:
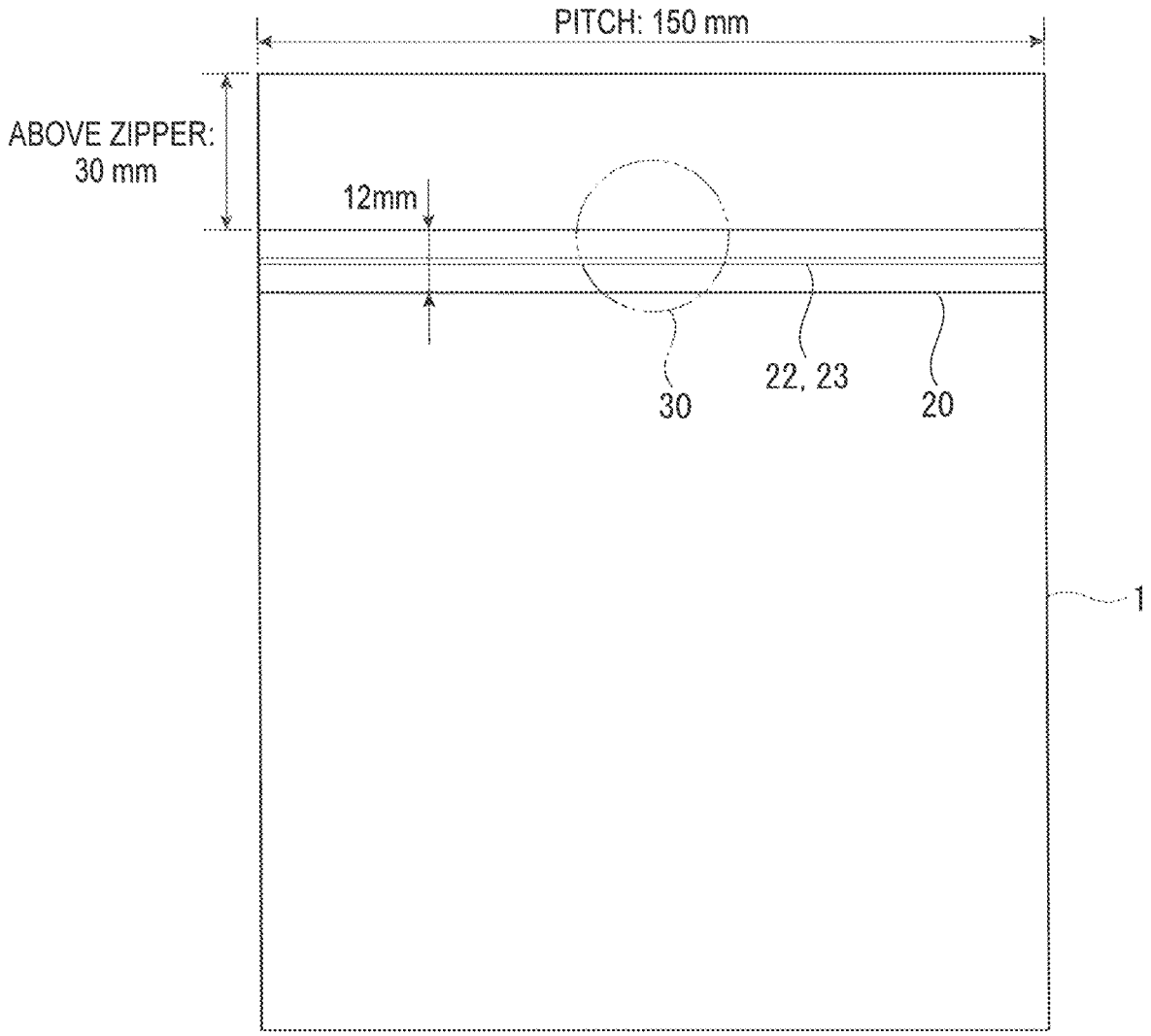
FIG. 20 is a plan view of a zipper-tape-attached bag body showing measurement conditions in an opening experiment for explaining the invention.
Figure 21:
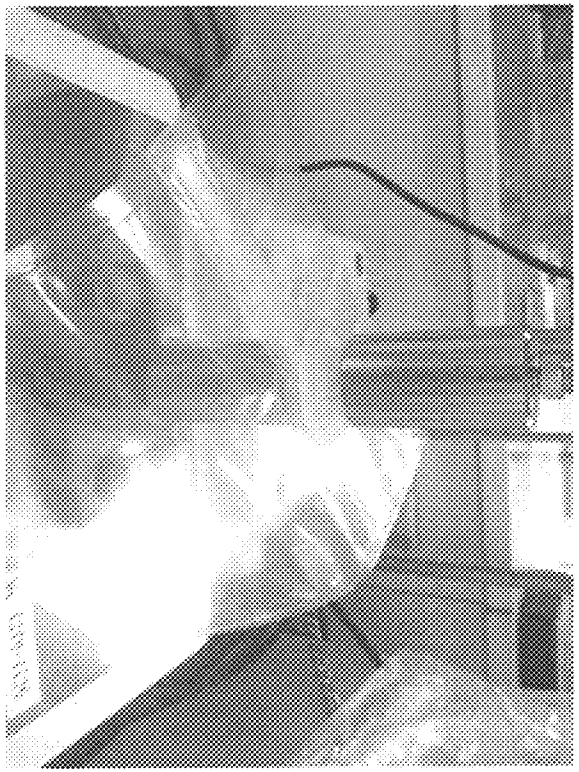
FIG. 21 is a photograph showing a measurement state of the opening experiment for explaining the invention.

Test method of opening strength: Using a digital force gauge (product name: Si DPZ-200N) manufactured by IMADA CO., LTD., a force required for opening the zipper-tape-attached bag body 1 (width 150 mm, height 180 mm) was measured as shown in FIGS. 20, 21 by sucking the zipper-tape-attached bag body 1 with a sucker by a force of 60 kPa at a rate of 300 mm/min at a position where the mating portions 22, 23 of the zipper tape 20 are at one third of a diameter of the sucker. Five zipper tapes were produced, each of which was subjected to the measurement.

Test method of non-open-side mating strength: The zipper tape 20 of the zipper-tape-attached bag body 1 was cut at a width of 50 mm. A part of the bag main body 10 at a position away from the center of the mating portions 22, 23 by 20 mm in parallel to the zipper tape 20 toward the containing space 14 was sucked using the sucker in a manner similar to the test method of the opening strength, and the force required for pulling to open the bag was measured. Five zipper tapes were produced, each of which was subjected to the measurement.

Figure 22:
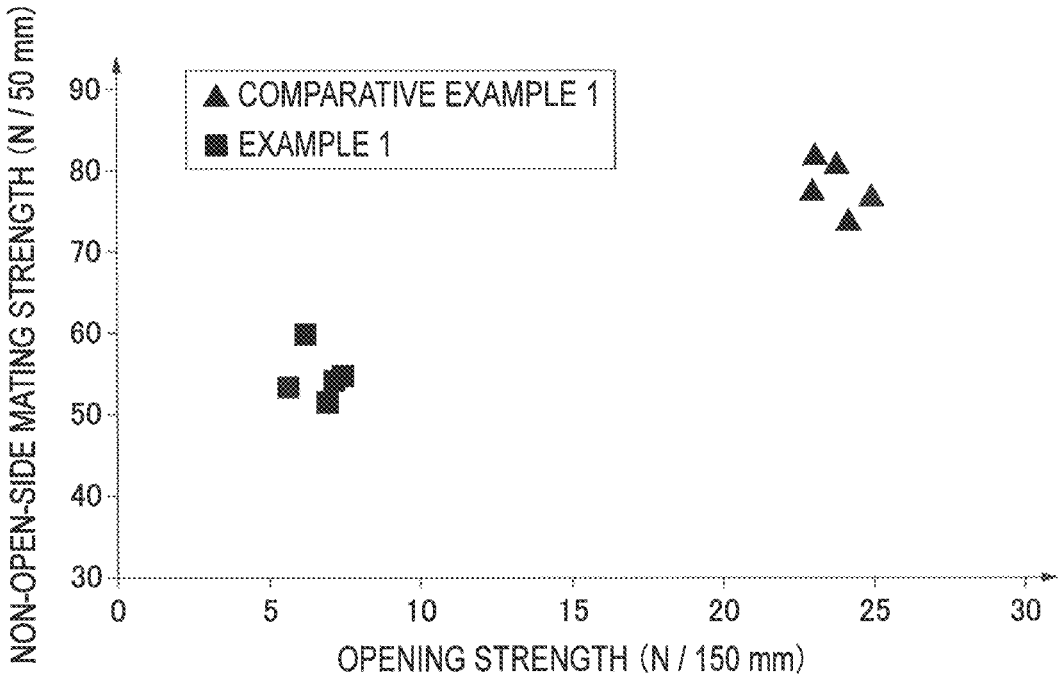
FIG. 22 is a graph showing results of the opening experiment for explaining the invention, where an abscissa axis represents an opening strength and an ordinate axis represents a non-open-side mating strength.

The results of the measurements are shown in a graph in FIG. 22, where the abscissa axis represents the opening strength and the ordinate axis represents the non-open-side mating strength.

Comparative Example 1

Figure 19B:
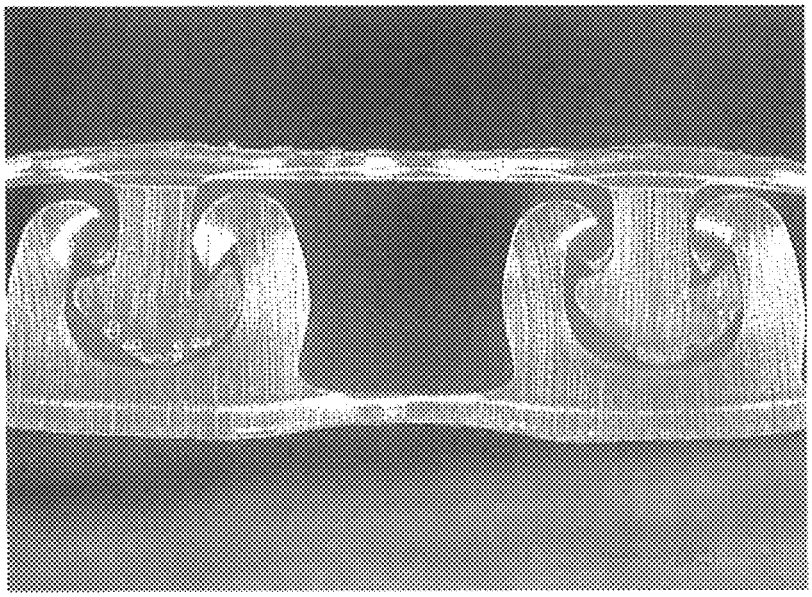
FIG. 19B is a photograph showing a state of an opening in a comparative example for explaining the invention.

Using the same material as that used in Example 1, as shown in FIG. 19B, the zipper tape 20 having two second mating portions 23, in which the male mating portion 23B of each of the second mating portions 23 included not only the nail 22D but included both of the nail 22D and the small nail 22G, was used to measure the opening strength and the non-open-side mating strength of the zipper tape 20 in the same manner as in Example 1. The results are shown in FIG. 22.

As is evidenced by the graph shown in FIG. 20, while a large non-open-side mating strength can be obtained, the zipper tape in Comparative Example 1 provided with both of the nail 22D and the small nail 22G has a large opening strength and a large force is required for separating the tape, resulting in difficulty in the opening operation. On the other hand, it is observable that the zipper tape in Example 1 provided only with the nail 22D, while exhibiting a certain level of the non-open-side mating strength, has extremely small opening strength, thereby facilitating the opening operation while keeping the sealing performance.

Example 2

The bag body 1 was produced using the same zipper tape 20 as that used in Example 1.

Figure 23:
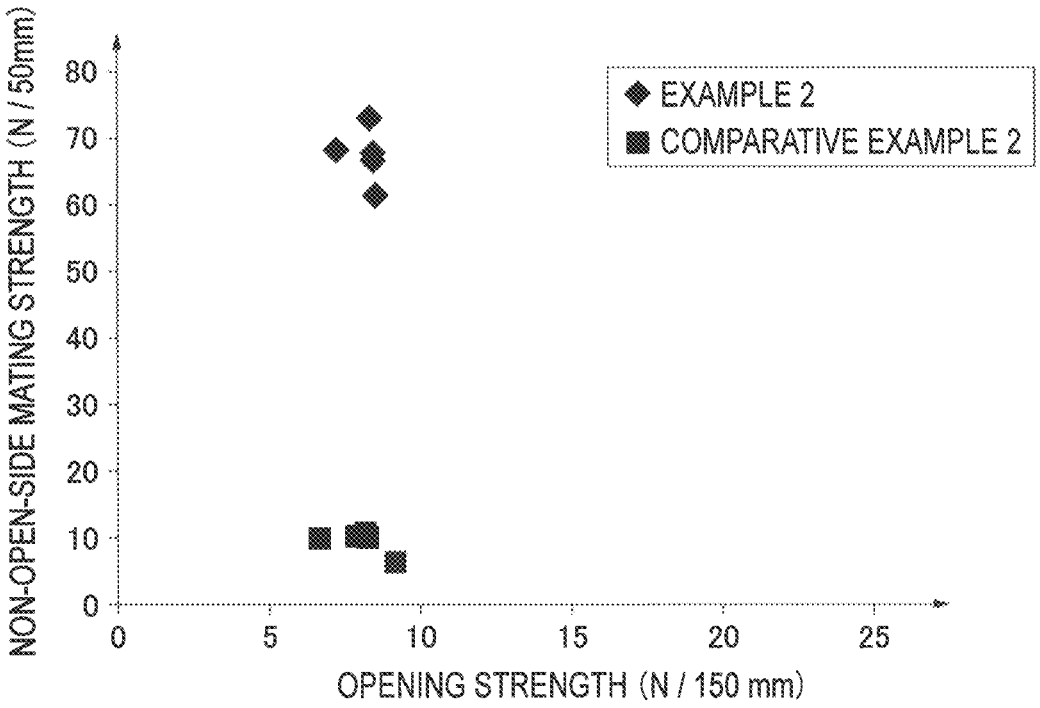
FIG. 23 is another graph showing results of the opening experiment in the Example and Comparative Example for explaining the invention, where an abscissa axis represents an opening strength and an ordinate axis represents a non-open-side mating strength.

Then, the opening strength and the non-open-side mating strength were measured in the same manner as those in Example 1. The results are shown in FIG. 23.

Comparative Example 2

Except that the whole surface of the first belt-shaped base 21A of the zipper tape 20 was heat-sealed to the base film 11, the bag body 1 was produced in the same manner as in Example 2 and the opening strength and the non-open-side mating strength were measured. The results are shown in FIG. 21.

The graph shown in FIG. 21 shows that, though the opening strength of the zipper tape of the Comparative Example 2 is small and can be easily unsealed, the non-open-side mating strength of the zipper tape is small and sufficient sealing performance cannot be obtained. On the other hand, while the opening strength in Example 2 is small similarly to Comparative Example 2 and thus the zipper tape can be easily unsealed, the zipper tape provides a large non-open-side mating strength, thereby exhibiting high sealing performance.

The invention claimed is:

1. A zipper-tape-attached bag body comprising:

a bag main body with an at least one peripheral edge which is suitable as an opening; and a zipper tape comprising:

a first mating member comprising:

a first belt-shaped base attached along the peripheral edge of the bag main body, a first mating portion, having a male profile, provided on the first belt-shaped base, and a second mating portion, having a first hook profile, provided on the first belt-shaped base in parallel to the first mating portion and farther from the at least one peripheral edge in relation to the first mating portion; and, a second mating member comprising:

a second belt-shaped base attached along the peripheral edge of the bag main body, a third mating portion, having a female profile configured to be mated with the first mating portion, provided on the second belt-shaped base, and a fourth mating portion, having a second hook profile configured to be mated with the second mating portion, provided on the second belt-shaped base in parallel to the third mating portion and farther from the at least one peripheral edge in relation to the third mating portion, wherein the male profile of the first mating portion comprises a first nail positioned toward an interior of the bag main body and a small nail smaller than the first nail and provided on a side opposite a side from which the first nail protrudes, wherein the second belt-shaped base is attached to the bag main body on only one widthwise side of the second mating member near the at least one peripheral edge, and the first belt-shaped base is attached to the bag main body on both widthwise sides of the first mating member, wherein the first hook profile of the second mating portion provided on the first belt-shaped base comprises a first protrusion and a second nail positioned on a surface of the first protrusion toward the interior of the bag main body and does not comprise a nail positioned toward the at least one peripheral edge, wherein the second hook profile of the fourth mating portion provided on the second belt-shaped base comprises a second protrusion and a third nail positioned on a surface of the second protrusion toward the at least one peripheral edge and does not comprise a nail positioned toward the interior of the bag main body, the third nail being configured to be engageable and disengageable with the second nail, and wherein the zipper tape is suitable for opening by grasping and pulling apart the at least one peripheral edge of the bag main body.

2. The zipper-tape-attached bag body according to claim 1, wherein the second mating portion and the fourth mating portion comprise a plurality of pairs of the second mating portion and the fourth mating portion.

3. The zipper-tape-attached bag body according to claim 1, wherein the zipper tape comprises a reinforcing portion provided on at least one of the first and second belt-shaped bases, the reinforcing portion being arranged in parallel to the second mating portion or the fourth mating portion and configured to be in contact with the second mating portion or the fourth mating portion when the second mating portion or the fourth mating portion are deformed.

4. The zipper-tape-attached bag body according to claim 1, wherein the first mating portion and the third mating portion comprise a plurality of pairs of the first mating portion and the third mating portion.

5. A method for producing the zipper-tape-attached bag body of claim 1, the method comprising:

attaching the zipper tape to a film; and forming the film into a shape of a bag with the at least one peripheral edge which is suitable as the opening.

* * * * *